US006381760B1

(12) United States Patent
Lampe et al.

(10) Patent No.: US 6,381,760 B1
(45) Date of Patent: May 7, 2002

(54) PROTECTIVE HEADGUARD

(75) Inventors: John K. Lampe; Robert C. Long; George C. Halvorson, all of St. Paul, MN (US)

(73) Assignee: Soccerdocs. Inc., St. Paul, MN (US)

( * ) Notice: Subject to any disclaimer, the term of this patent is extended or adjusted under 35 U.S.C. 154(b) by 0 days.

(21) Appl. No.: 09/663,546

(22) Filed: Sep. 15, 2000

Related U.S. Application Data

(60) Provisional application No. 60/154,754, filed on Sep. 17, 1999.

(51) Int. Cl.[7] ..... A63B 71/10

(52) U.S. Cl. ..... 2/425; 2/414; 2/418

(58) Field of Search ..... 2/425, 414, 411, 2/417, 418, 419, 421

(56) References Cited

U.S. PATENT DOCUMENTS

| | | | | |
|---|---|---|---|---|
| 532,567 | A | 1/1895 | Larwood, Jr. | |
| 2,969,547 | A | 1/1961 | Dye | 2/3 |
| 3,171,133 | A | 3/1965 | Steffen | 2/3 |
| 3,725,956 | A | 4/1973 | Reisen | 2/200 |
| 3,784,984 | A | 1/1974 | Aileo | 2/3 R |
| 3,992,721 | A | 11/1976 | Morton | 2/3 R |
| 4,023,209 | A | 5/1977 | Frieder, Jr. et al. | 2/6 |
| 4,044,400 | A | 8/1977 | Lewicki et al. | 2/421 |
| 4,058,854 | A | 11/1977 | Rhee | 2/412 |
| 4,062,067 | A | 12/1977 | Franzen | 2/410 |
| 4,075,717 | A | 2/1978 | Lemelson | 2/412 |
| 4,239,106 | A | 12/1980 | Aileo | 206/223 |
| 4,290,149 | A | 9/1981 | Aileo | 2/414 |
| 4,317,239 | A | 3/1982 | Bryksa | 2/411 |
| 4,345,336 | A | 8/1982 | Plastino | 2/187 |
| 4,354,284 | A | 10/1982 | Gooding | 2/413 |
| 4,398,306 | A | 8/1983 | Gooding | 2/421 |
| 4,404,690 | A | 9/1983 | Farquharson | 2/420 |
| 4,443,891 | A | 4/1984 | Blomgren et al. | 2/414 |

(List continued on next page.)

FOREIGN PATENT DOCUMENTS

| | | | |
|---|---|---|---|
| FR | 2 390 116 | 5/1977 | A41D/21/00 |
| GB | 2 202 729 A | 10/1988 | A42B/3/00 |
| GB | 2 318 500 A | 4/1998 | A63B/71/10 |
| GB | 2 333 690 A | 8/1999 | A63B/71/10 |
| WO | WO 88/04188 | 6/1988 | A63B/71/10 |
| WO | WO 99/29199 | 6/1999 | A42B/3/00 |

OTHER PUBLICATIONS

Seven Photographs of "Glibert Rugby" head protector, date unknown.

Seven Photographs of "CCC" head protector, date unknown.

Fellow, Fishbein, "Can Sports–Minded Kids Have Too Many Helmets?", *Medical News and Perspectives*, vol. 275, No. 18, p. 1391, May 8, 1996.

Tysvaer, Alf Thorvald, Head and Neck Injuries in Soccer, Impact of Minor Trauma, *Sports Medicine*, vol. 14, No. 3, p. 200–213, 1992.

*Primary Examiner*—Rodney M. Lindsey
(74) *Attorney, Agent, or Firm*—Michael S. Sherrill

(57) ABSTRACT

Headguards for athletes, particularly soccer players, having a foam outer shell and attachment points for an interior padding or suspension system. The interior padding and/or the outer shell may independently be formed as a single unitary piece or a system of separately moveable parts.

29 Claims, 25 Drawing Sheets

U.S. PATENT DOCUMENTS

| | | | | |
|---|---|---|---|---|
| 4,481,681 | A | 11/1984 | Hankin | 2/197 |
| 4,484,364 | A | 11/1984 | Mitchell et al. | 2/413 |
| 4,539,715 | A | 9/1985 | Clement | 2/420 |
| 4,558,470 | A | 12/1985 | Mitchell et al. | 2/414 |
| 4,581,773 | A | 4/1986 | Cunnane | 2/204 |
| 4,612,672 | A | 9/1986 | Schrack | 2/68 |
| 4,613,993 | A | 9/1986 | Steele et al. | 2/411 |
| 4,646,367 | A | 3/1987 | El Hassen | 2/411 |
| 4,698,852 | A | 10/1987 | Romero | 2/171 |
| 4,706,305 | A | 11/1987 | Cho | 2/425 |
| 4,710,985 | A | 12/1987 | Dubner et al. | 2/425 |
| 4,766,614 | A | 8/1988 | Cantwell et al. | 2/414 |
| 4,768,231 | A | 9/1988 | Schrack | 2/12 |
| 4,790,035 | A | 12/1988 | Whyte | 2/207 |
| 4,827,537 | A | 5/1989 | Villa | 2/410 |
| 4,843,642 | A | 7/1989 | Brower | 2/6 |
| 4,864,662 | A | 9/1989 | Frank | 2/183 |
| 4,910,804 | A | 3/1990 | Lidgren | 2/209 |
| 4,947,488 | A | 8/1990 | Ashinoff | 2/181 |
| 4,982,451 | A | 1/1991 | Graham | 2/410 |
| 5,012,533 | A | 5/1991 | Raffler | 2/420 |
| 5,042,093 | A | 8/1991 | Legendre | 2/419 |
| 5,044,016 | A | 9/1991 | Coombs | 2/414 |
| 5,075,903 | A | 12/1991 | Richoux | 2/411 |
| 5,081,717 | A | 1/1992 | Shedd et al. | 2/199 |
| 5,083,321 | A | 1/1992 | Davidsson | 2/421 |
| 5,173,970 | A | 12/1992 | Shifrin | 2/410 |
| 5,177,815 | A | 1/1993 | Andujar | 2/411 |
| 5,184,354 | A | 2/1993 | Alfaro et al. | 2/425 |
| D339,677 | S | 9/1993 | Kang | D2/512 |
| 5,271,103 | A | 12/1993 | Darnell | 2/418 |
| 5,315,718 | A | 5/1994 | Barson et al. | 2/418 |
| 5,361,420 | A | 11/1994 | Dobbs et al. | 2/425 |
| 5,392,468 | A | 2/1995 | Leddick, III | 2/424 |
| 5,421,035 | A | 6/1995 | Klose et al. | 2/411 |
| 5,437,064 | A | 8/1995 | Hamaguchi | 2/414 |
| 5,450,631 | A | 9/1995 | Egger | 2/425 |
| 5,504,945 | A | 4/1996 | Purnell | 2/425 |
| 5,511,250 | A | 4/1996 | Field et al. | 2/418 |
| D370,309 | S | 5/1996 | Stucky | D29/102 |
| 5,515,546 | A | 5/1996 | Shifrin | 2/410 |
| 5,519,895 | A | 5/1996 | Barnes, Jr. | 2/422 |
| 5,535,454 | A | 7/1996 | Ryan | 2/425 |
| 5,544,367 | A | 8/1996 | March, II | 2/410 |
| 5,551,094 | A | 9/1996 | Navone | 2/421 |
| 5,615,419 | A | 4/1997 | Williams | 2/411 |
| 5,628,071 | A | 5/1997 | Nezer | 2/410 |
| 5,638,551 | A | 6/1997 | Lallemand | 2/421 |
| 5,640,721 | A | 6/1997 | Jackson | 2/171 |
| 5,659,900 | A | 8/1997 | Arney et al. | 2/417 |
| 5,661,854 | A | 9/1997 | March, II | 2/410 |
| 5,680,656 | A | 10/1997 | Gath | 2/424 |
| 5,701,609 | A | 12/1997 | Bridges | 2/422 |
| 5,704,072 | A | 1/1998 | Garneau | 2/421 |
| 5,774,901 | A | 7/1998 | Minami | 2/421 |
| 5,790,988 | A | 8/1998 | Guadagnino, Jr. et al. | 2/411 |
| 5,815,847 | A | 10/1998 | Holden, Jr. | 2/418 |
| 5,862,528 | A | 1/1999 | Saijo et al. | 2/411 |
| 5,882,205 | A | 3/1999 | Peterson | 434/251 |
| D410,768 | S | 6/1999 | Hirsh | D29/102 |
| 5,930,841 | A | 8/1999 | Lampe et al. | 2/411 |
| 5,946,734 | A | 9/1999 | Vogan | 2/412 |
| 5,963,989 | A | 10/1999 | Robertson | 2/411 |
| 6,000,062 | A | 12/1999 | Trakh | 2/171 |
| 6,065,159 | A | 5/2000 | Hirsh | 2/425 |
| 6,266,827 | B1 * | 7/2001 | Lampe et al. | 2/414 |

* cited by examiner

PROTECTIVE HEADGUARD

This application claims the benefit of U.S. Provisional Application No. 60/154,754, filed Sep. 17, 1999.

FIELD OF INVENTION

The present invention generally relates to protective headguards for athletics and, more particularly, relates to a protective headguard for soccer players. The purpose of the headguard is to provide protection to a soccer player's head from injuries encountered during play of the game without unduly disrupting the traditional way in which the game is played.

BACKGROUND OF THE INVENTION

Participants in many sports are increasingly using protective headgear of various kinds. Football players have long worn helmets to protect themselves from blows to the head and face. Sometime later hockey players also began to protect themselves with helmets. More recently recreational bicyclists have perceived the need to use protective headgear and have started to wear helmets in increasing numbers.

Traditionally, soccer players have not worn any protective headgear. This is probably the case for two main reasons. First, soccer players or organizers of the game may not have sensed a need to use headgear because injuries to the head may not have seemed as commonplace as in sports such as football, hockey, and bicycling. Second, soccer is one of the few sports where the head itself is intentionally and legitimately used to strike the ball. This requires considerable muscle coordination and use of the senses of sight and touch. An improperly constructed piece of headgear may hamper a player's ability to head the ball properly.

Recent medical research has demonstrated that head injuries may be more prevalent in soccer than previously thought. Several studies have suggested that soccer players may suffer minor trauma from repeatedly heading the ball. This injury has been analogized to pugilistic dementia, the harm that boxers suffer from repeated strikes to the head in boxing. Alf Thorvald, Head and Neck Injuries in Soccer—Impact of Minor Trauma, *Sports Medicine,* 14(3):200–213 (1992). This danger of trauma in soccer may be greater for children. Their skills at heading are less well honed. Their bodies may not be developed enough to withstand or counteract the blow caused by a ball. Id. at 210. Therefore, at least from a safety standpoint, use of headgear by soccer players seems advisable.

The unique demands of the sport of soccer require unique headgear. Although multipurpose protective headgear for sports are being developed, most forms of headgear for use in team sports are intended for one sport and should not be used in other activities. Thomas B. Cole, Can Sports Minded Kids Have Too Many Helmets?, *Journal of the American Medical Association,* 275(18): 1391 (May 8, 1996). A brief review of patents for headgear constructed for other sports shows how such headgear would not meet the specialized needs of soccer players. For example, football and hockey helmets are ill-suited for soccer. Their bulk would likely discourage soccer players unaccustomed to helmets from wearing them. In addition this bulk and the hard, sometimes uneven surfaces of such helmets would make it very difficult to control the direction and distance of a headed ball. Finally, other unprotected soccer players might suffer injuries caused by the hard-surfaced headgear of the wearer. See, e.g., U.S. Pat. No. 4,404,690 (hockey helmet).

Other helmets would also not work effectively as soccer headgear. Bicycle helmets are light but would make control of the ball difficult; they are built to withstand one substantial blow; and their ventilation systems would likely not be effective in soccer. See, e.g., U.S. Pat. No. 5,450,631 Wrestling headgear protects the ears and only incidentally, if at all, protects the surfaces of the head. See, e.g., U.S. Pat. No. 5,361,420.

U.S. Pat. No. 4,698,852 illustrates protective headgear specifically designed for use in soccer. This headgear, however, has several shortcomings. The headband shape of the headgear protects only the forehead, neglecting other parts of the head which may be used, properly, and improperly, to strike balls. The headband shape moreover creates a ridge at the edge of the headband which may misdirect a headed ball. In addition, the materials and retention system of this headgear likely would cause the headgear to slip up or down on the wearer's head or, if tightened, may strain the wearer's head.

SUMMARY OF THE INVENTION

Generally, the present invention relates to improvements to a headguard for athletes and in particular soccer players. The headguard consists of foam molded or fabricated into an outer shell and attachment points for attaching interior padding or a suspension system to the outer shell. The shell may consist of more than one part and may cover various parts of the head. Similarly the interior padding may consist of more than one part and may cover various parts of the head.

The above summary of the present invention is not intended to describe each illustrated embodiment of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings.

Figure 1:
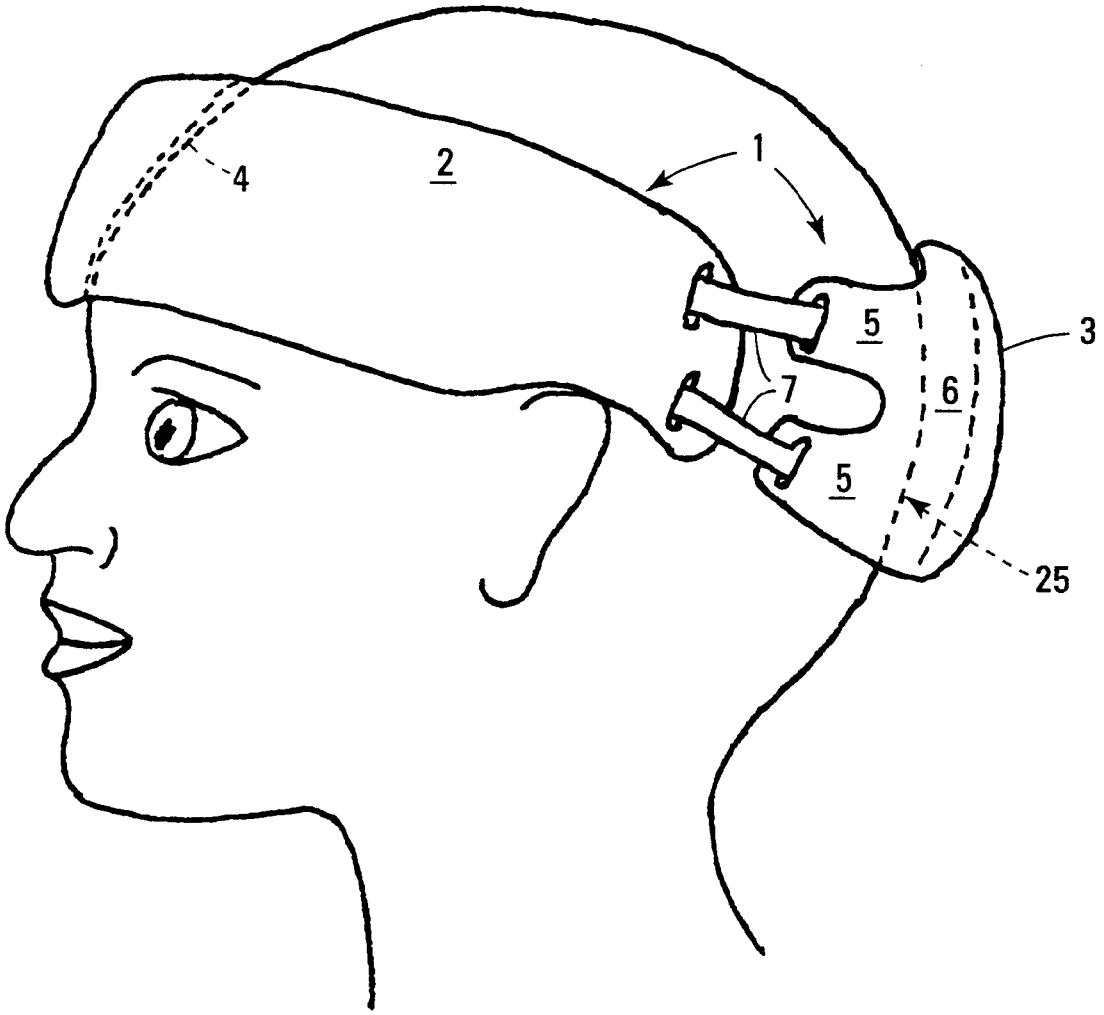
FIG. 1 is a side view of an exemplary headguard.

While the invention is amenable to various modifications and alternative forms, specifics thereof have been shown by way of example in the drawings and will be described in detail. It should be understood, however, that the intention is not to limit the invention to the particular embodiments described, although all embodiments described are intended to fall within the claims of this invention. On the contrary, the intention is to cover all modifications, equivalents, and alternatives falling within the spirit and scope of the invention as defined by the appended claims.

DETAILED DESCRIPTION OF THE DRAWING

The present invention is believed to be applicable to a number of different sports and is particularly suited to soccer where a player intentionally strikes the ball with the head. While the present invention is not so limited, an appreciation of various aspects of the invention will be gained through a discussion of the exemplary embodiments in connection with the examples provided below.

The padding is typically sufficiently flexible so as to conform to unique head shapes and sizes. The position of the padding may be suitably selected in consideration of the particular environment in which the headguard is worn. For example, when used during the play of soccer by an on-field player who heads the ball, the padding may be positioned to provide a relatively uniform exterior surface over portions of a player's head which generally come in contact with a soccer ball, thus allowing greater control of the ball.

The thickness of the padding may be suitably selected in consideration of the portion of the head which the padding is to cover as well as in consideration of the particular environment in which the headguard is worn. For example, the thickness of the padding may vary among the top, front, side, and back portions of the padding. Pad thickness for the outer shell of around, for example, ¼ to 1 and ½ inches, would be suitable for many applications. Suitable padding material includes solid and/or laminated foam, and foam formed from plastic, for example. Foam formed in an injection mold may be especially suited for the outer shell. Open-cell foam laminated with fabric may be suitable for the interior padding. Pad thickness for the interior padding of ⅛ to ¾ inches may be suitable for many applications.

Figure 2:
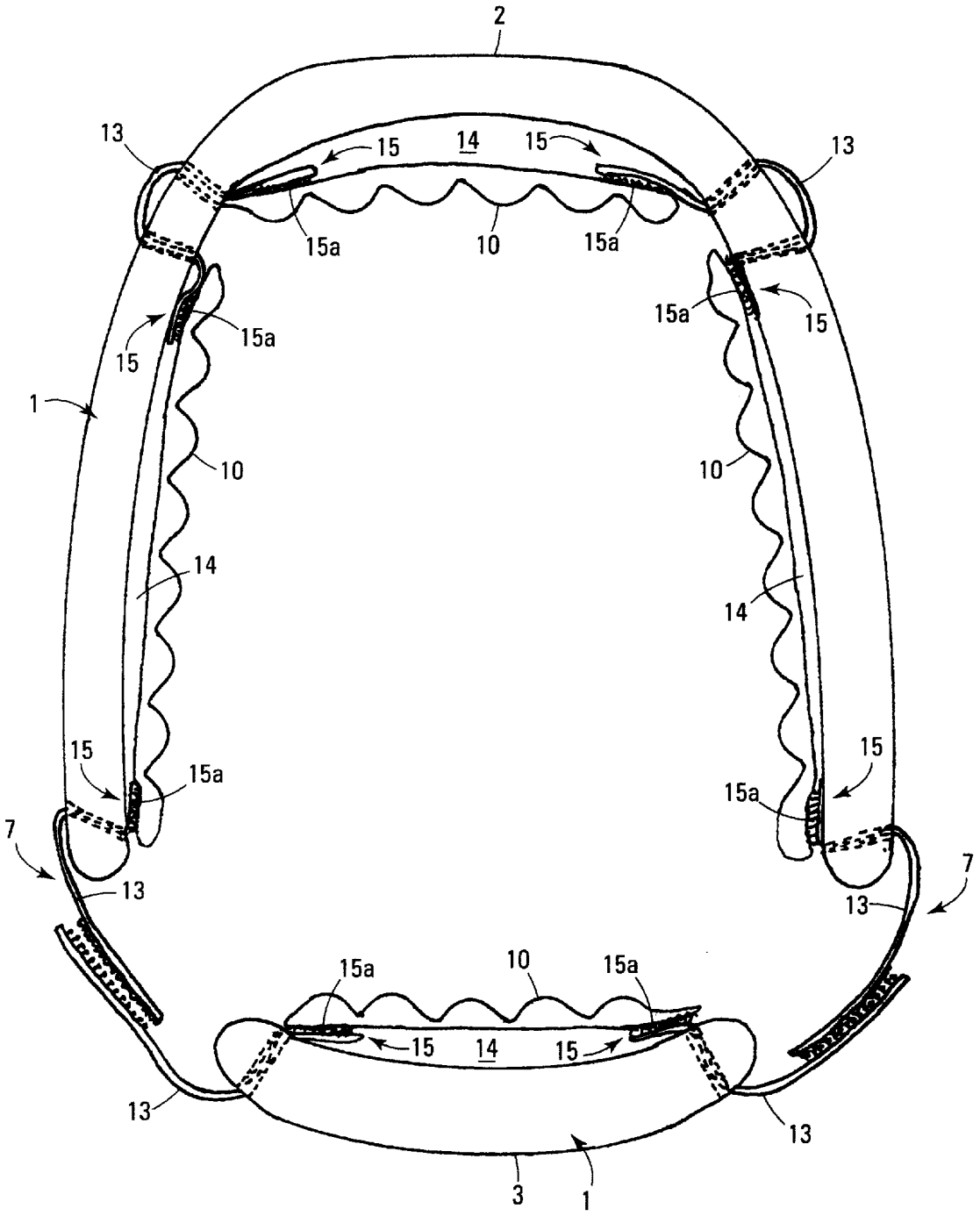
FIG. 2 is an overview of an exemplary headguard with interior padding.

In one embodiment the outer shell 1 consists of two pieces of molded or fabricated foam with a front 2 and rear 3 panel as shown in FIG. 1. The front panel 2 may be molded into a generally "u" shape as shown in FIG. 2 to fit the head of the wearer and extends from the forehead to the side of the head just behind the ears. The headguard may be contoured to fit around the head of the wearer. On the forehead the front panel 2 may begin just above the brow and extend upward. The top of the head may remain open.

The foam may also be molded or fabricated so as to curve to match the curve of the head from the vertical surfaces of the front, side, and back of the head to the top. In FIG. 1 the contouring 4 of the front portion of the headguard is shown. The curvature improves fit and retention of the headguard.

Figure 3:
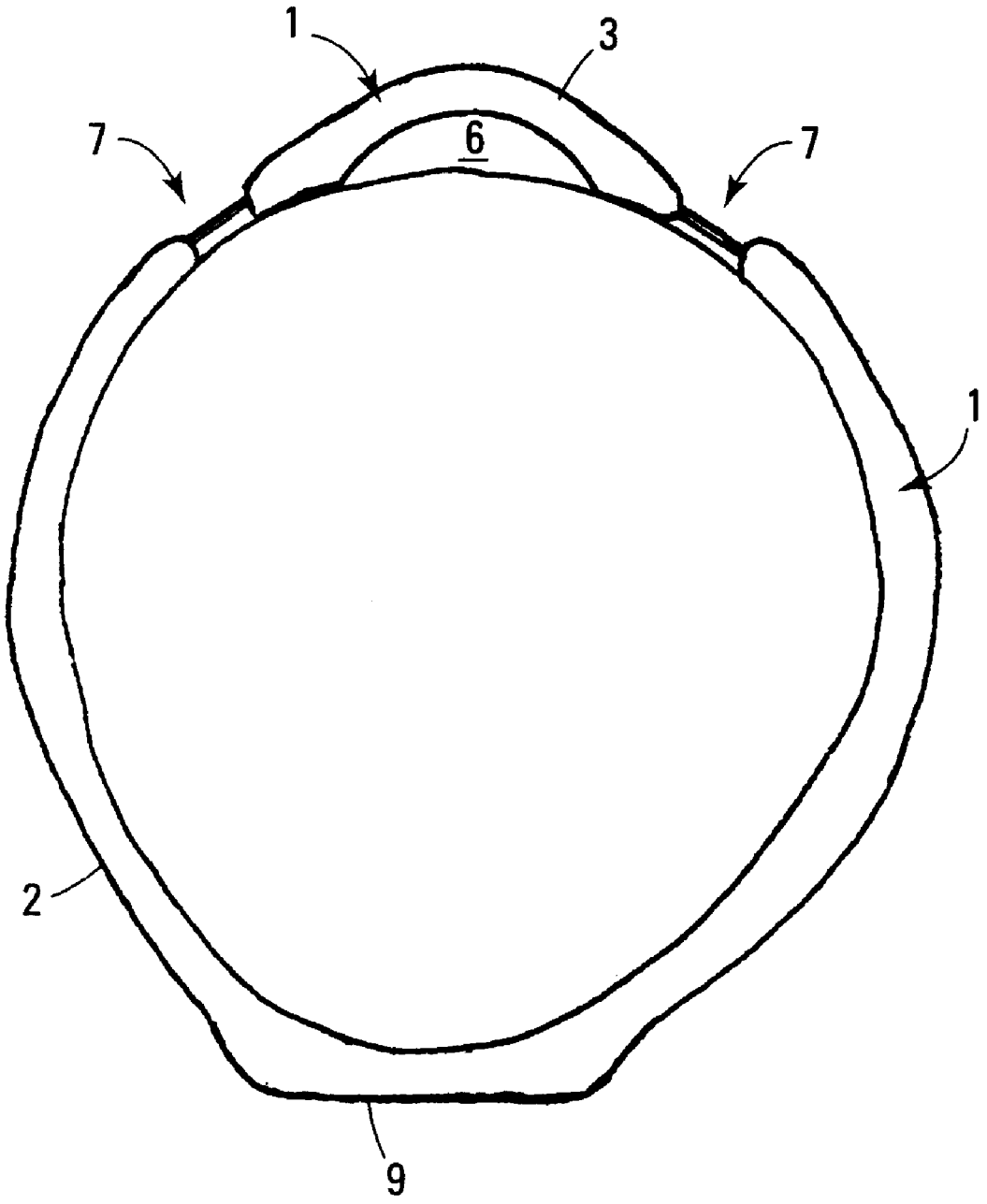
FIG. 3 is an overview of the outer shell of an exemplary headguard.

The rear panel 3 may be shaped to fit the back of the head surrounding the occipital bone 25. A depression may be molded in the middle to accommodate the protrusion of the occipital bone 25. The rear panel 3 may have four ribs 5 extending outward and forward along the side of the head as shown in FIG. 1. The rear panel 3 may have a channel 6, for example, a semi-hemispherical one, running vertically from the bottom edge to the top edge in the center of the rear panel 3 as shown in FIG. 3. This channel 6 may curve around the occipital bone 25 from top to bottom in order to improve retention on the head as shown in FIG. 1. The two panels 2 and 3 may be connected with stretchable adjustment straps 7.

Figure 4:
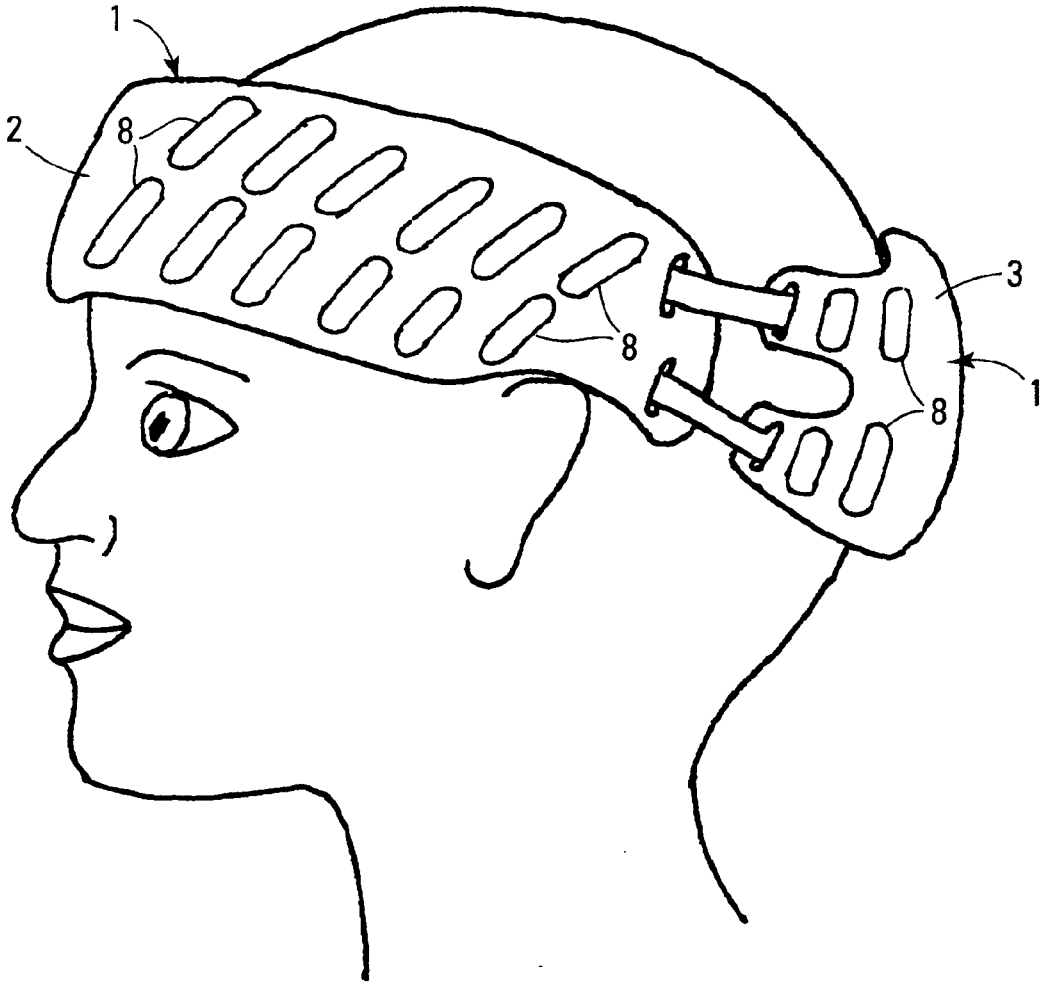
FIG. 4 is a side view of an exemplary headguard with vents.
Figure 5:
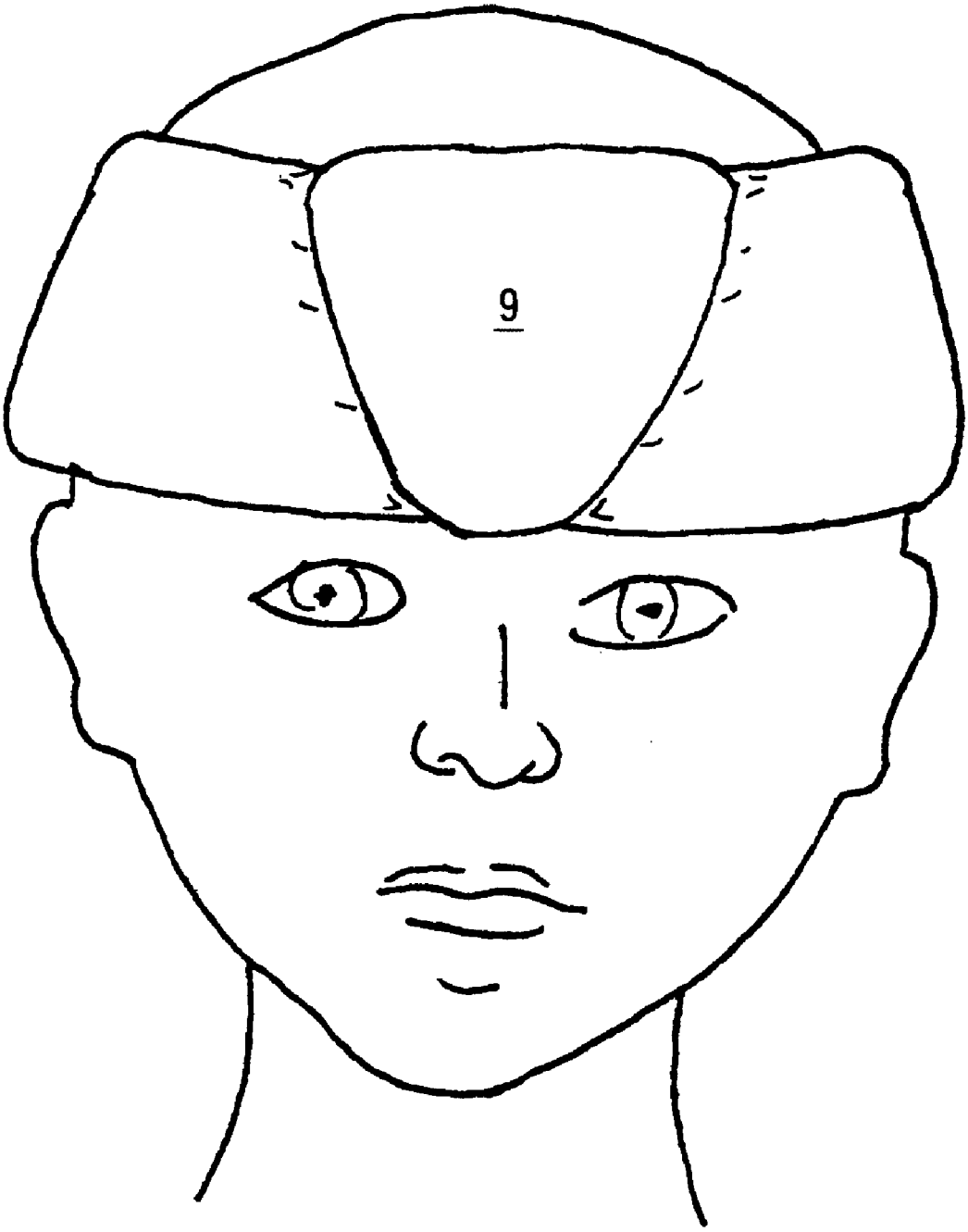
FIG. 5 is a front view of an exemplary headguard with a strike pad.

The panels 2 and 3 may have vents 8 molded into them as shown in FIG. 4. The vents 8 may be configured in different ways including in such a way, if the headguard is to be used by on-field players, so that they do not affect the ability of the wearer to head the ball. For on field players the strike pad 9, the area on the front of the forehead, may be shaped so as to create a larger flatter surface for heading the ball as illustrated in FIGS. 3 and 5.

Figure 6:
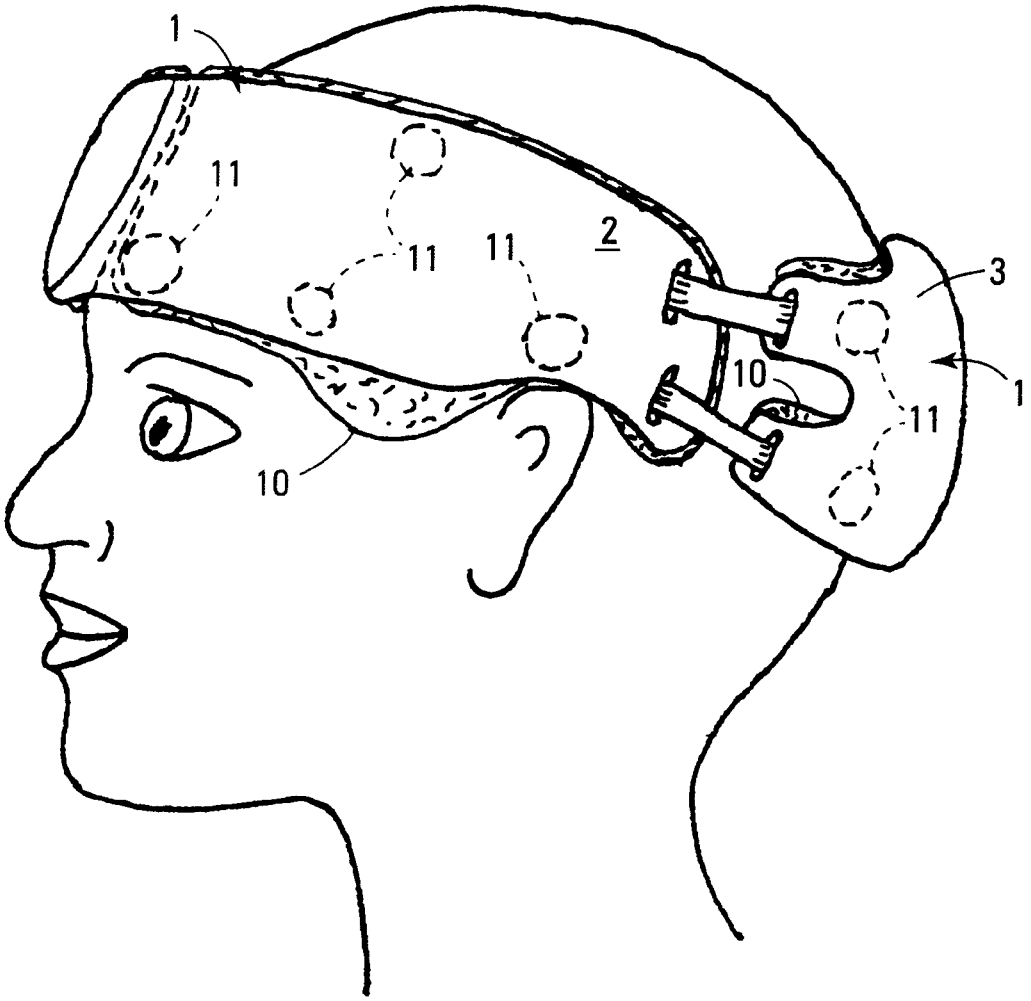
FIG. 6 is a side view of an exemplary headguard with interior padding.

Interior padding 10 may be deployed on the inside of the headguard. The interior padding 10 may be made of open cell foam or some other sweat absorbing material. It may be covered or laminated with fabric. The interior padding 10 may be mounted to the outer shell 1 by various means. The interior padding 10 may be attached by any of the conventional means well known in art. As shown in FIG. 6, the hook portion of hook and loop tape 11 could be sewn or glued onto or otherwise attached to the interior side of the outer shell 1, with open cell foam inserts covered with the loop portion of the hook and loop tape 11 attached at strategic points.

Figure 2A:
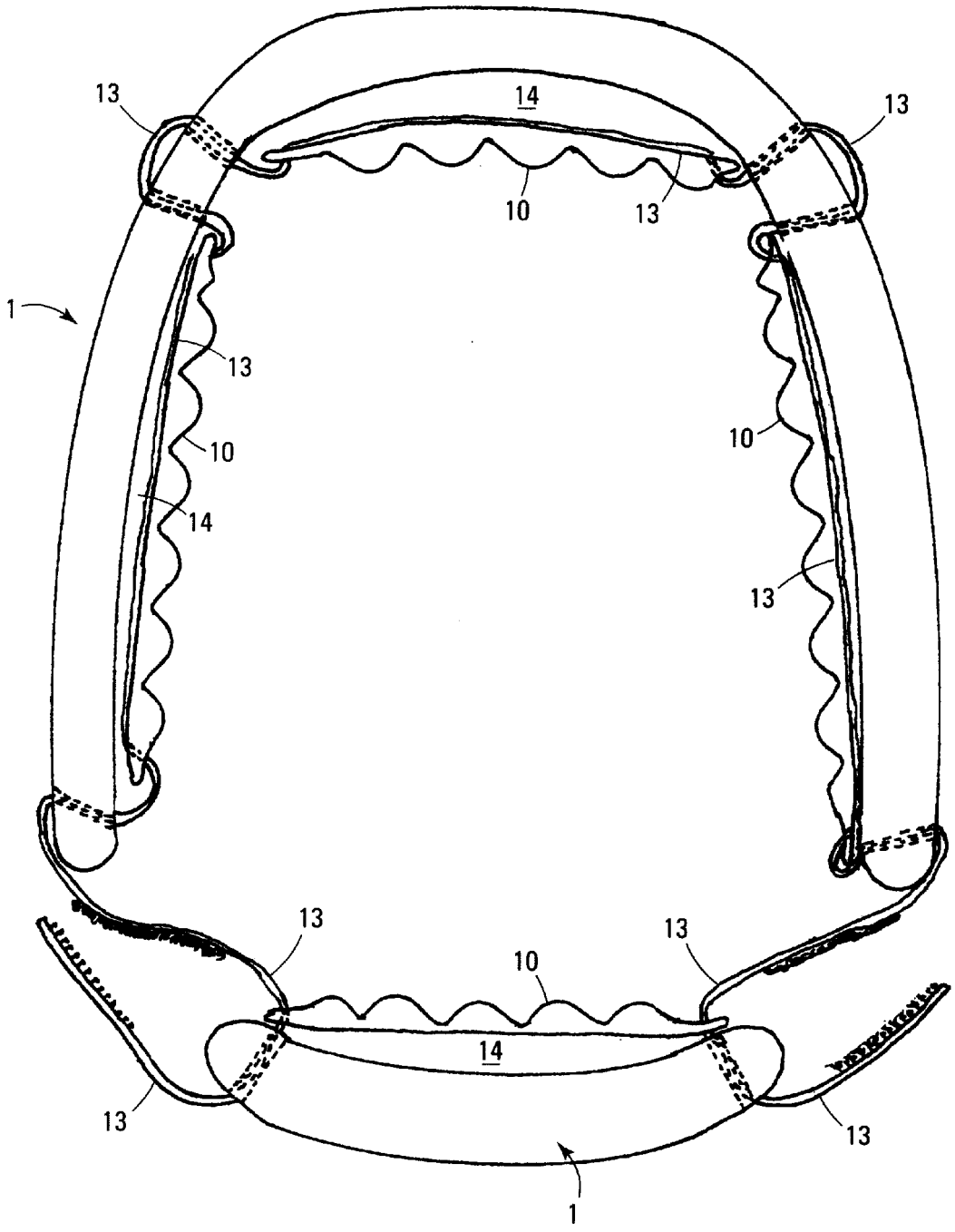
FIG. 2*a* is an overview of an exemplary headguard with interior padding.
Figure 7:
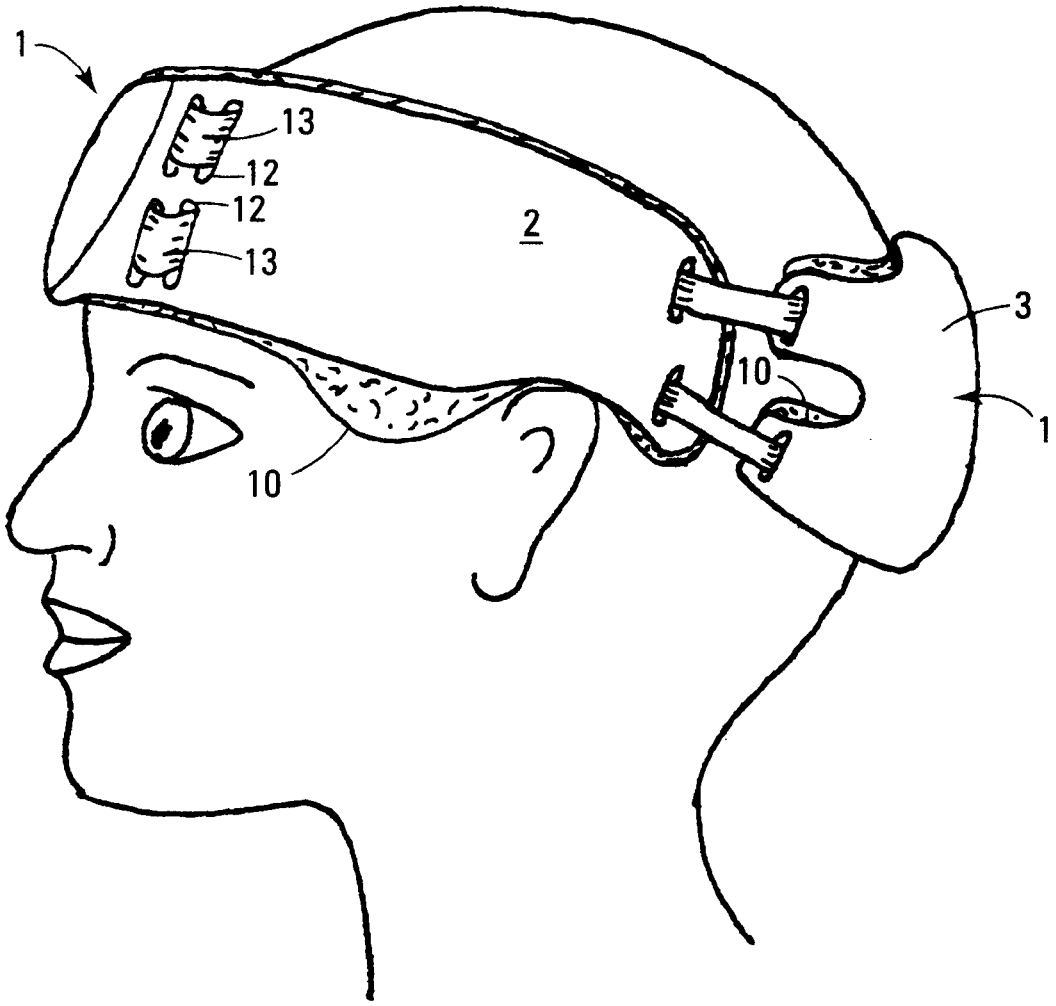
FIG. 7 is a side view of an exemplary headguard with interior padding and padding straps.
Figure 7A:
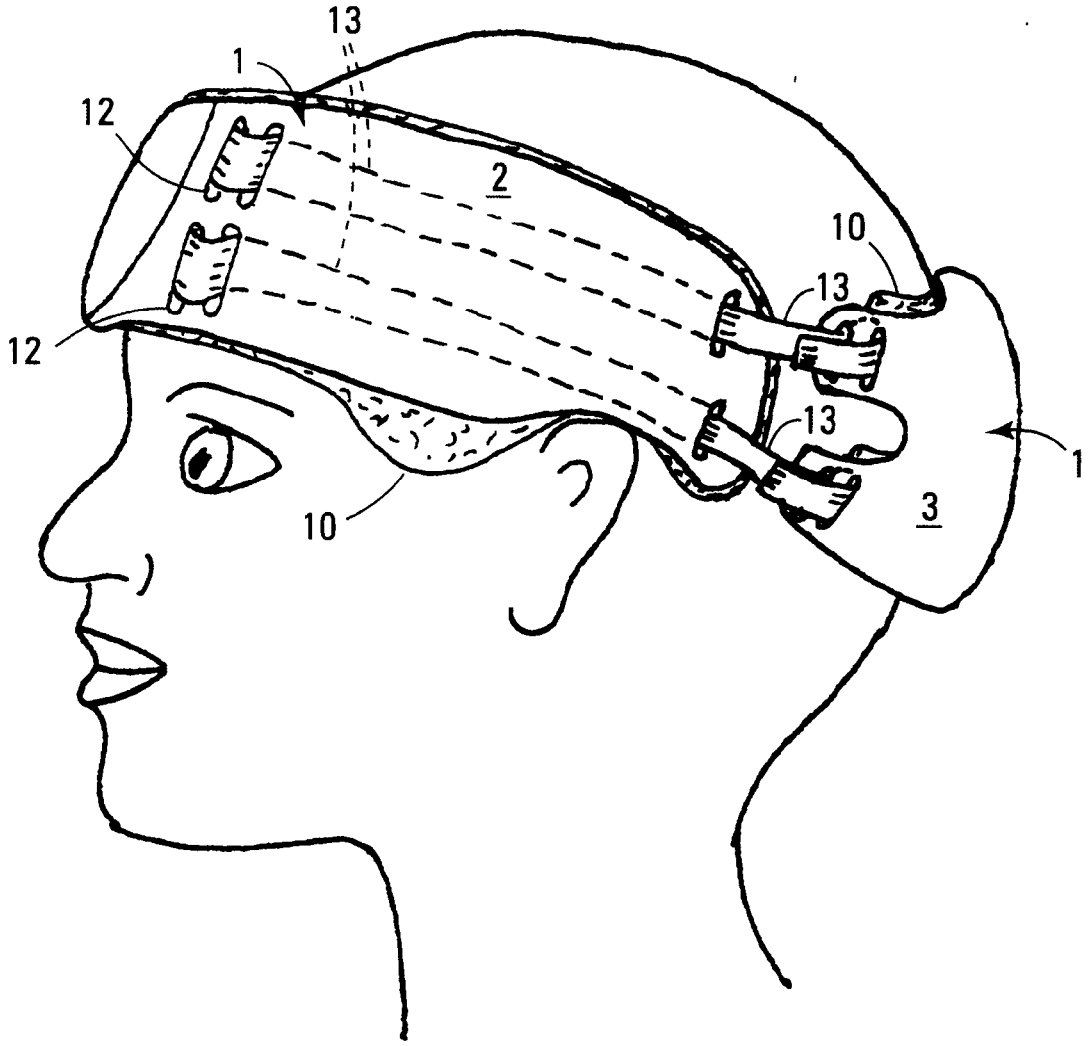
FIG. 7*a* is a side view of an exemplary headguard with interior padding and padding straps.
Figure 8:
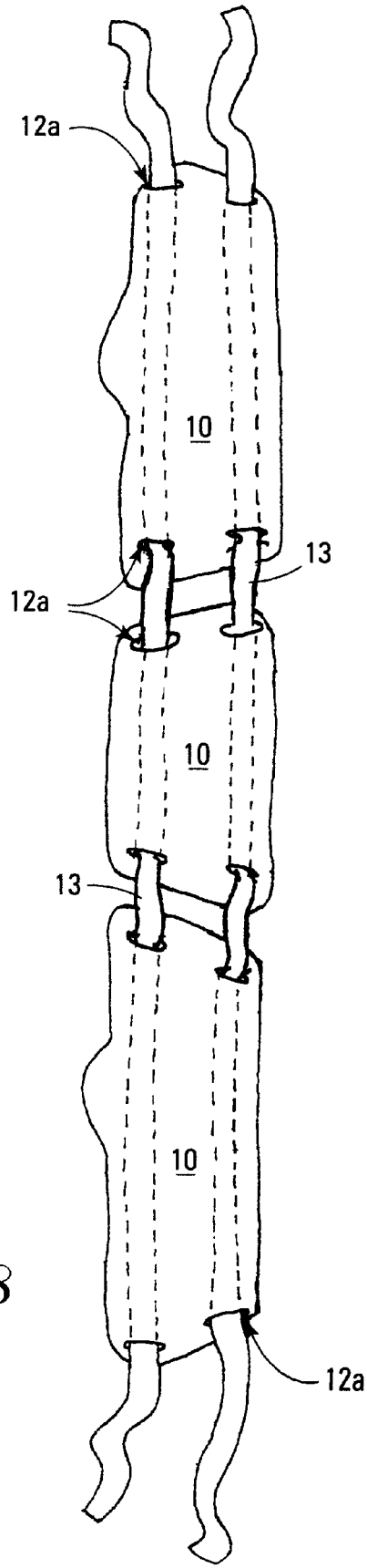
FIG. 8 is a view of interior padding for the front panel with padding straps.
Figure 8A:
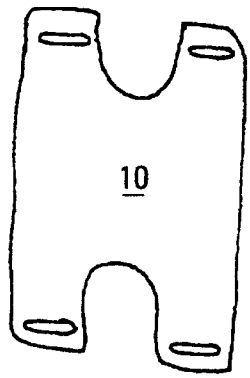
FIG. 8*a* is a view of interior padding for the rear panel.

Alternatively, slots 12 could be molded or fabricated into the outer shell 1 as illustrated in FIGS. 7 and 7*a*. The interior padding 10 could have strips of stretchable material, such as padding straps 13, attached to or integrated into them. The padding straps 13 could be woven through the slots 12 so as to keep the interior padding 10 in position. An example of the interior padding 10 is shown in FIG. 8. In this embodiment, the interior padding 10 for the front panel 2 has three sections with padding straps 13 threaded through slots 12*a* in the interior padding 10. The interior padding 10 for the rear panel 3 is shown in FIG. 8*a*. Examples of the means of attachment of the interior padding 10 to the outer shell 1 is shown in FIGS. 2, 2*a,* and 7 and 7*a.* In FIG. 7*a* a means is shown by which the padding strap 13 attaches the interior padding 10 to the front panel 2, connects the front panel 2 to the rear panel 3, and attaches the interior padding 10 to the rear panel 3. As shown in FIG. 2*a,* tension on the padding straps 13 may pull the interior padding 10 slightly away from the surface of the outer shell 1 thereby creating air space 14 between the interior padding 10 and the outer shell 1 to improve ventilation. In another embodiment, FIG. 2, the interior padding 10 is attached to the padding straps 13 that have hook strips 15 attached to them. The hook strips 15 attach to the loop fabric 15*a* on the interior padding 10.

Figure 9:
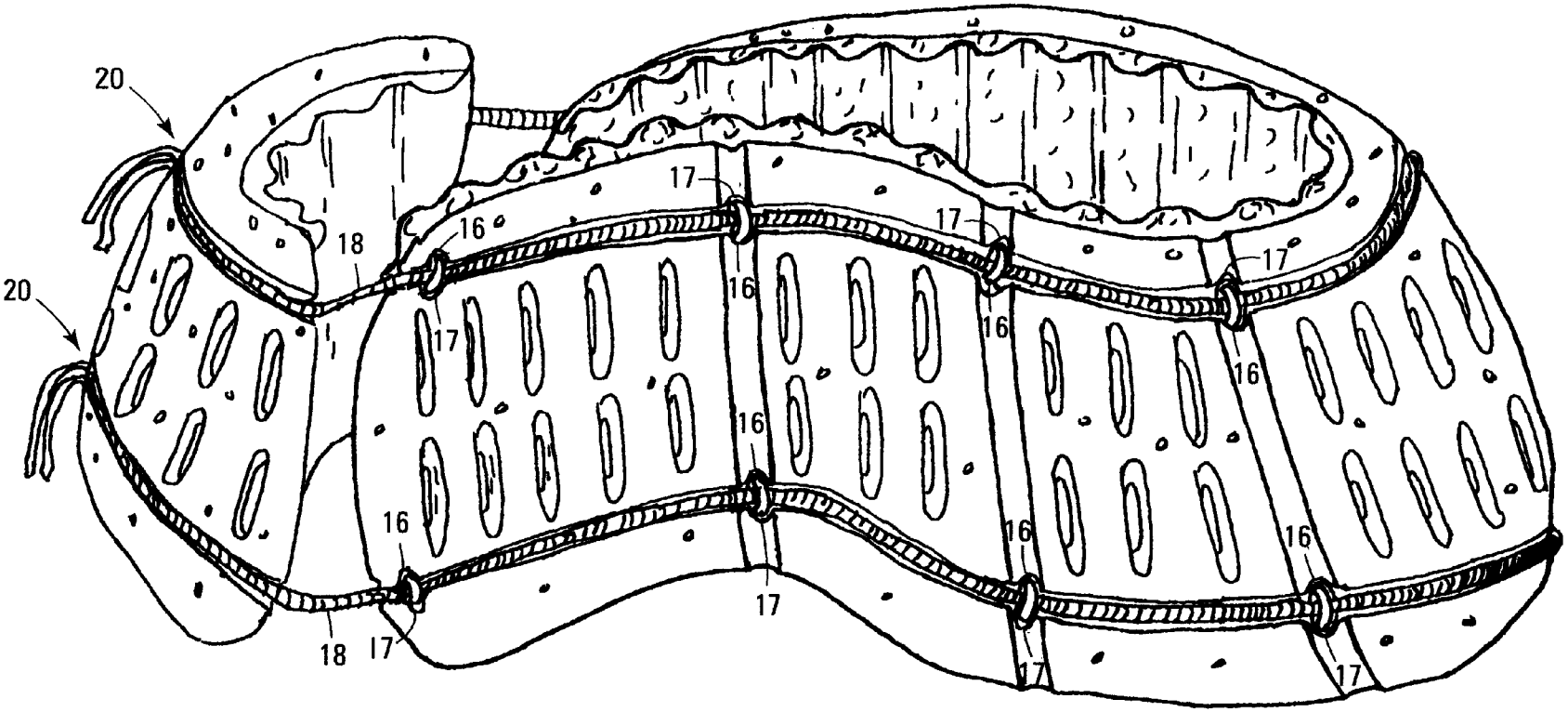
FIG. 9 is a side view of an exemplary headguard with interior padding and an exterior padding strap.
Figure 11:
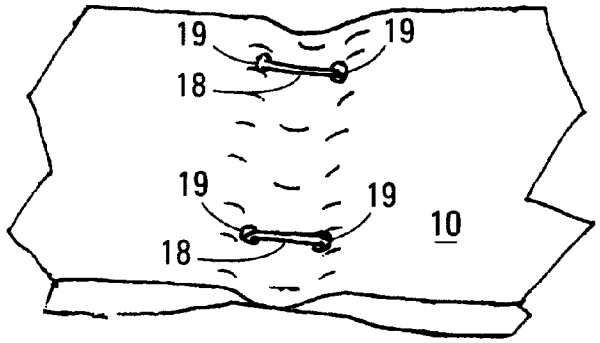
FIG. 11 is a view of interior padding with an exterior padding strap.
Figure 10:
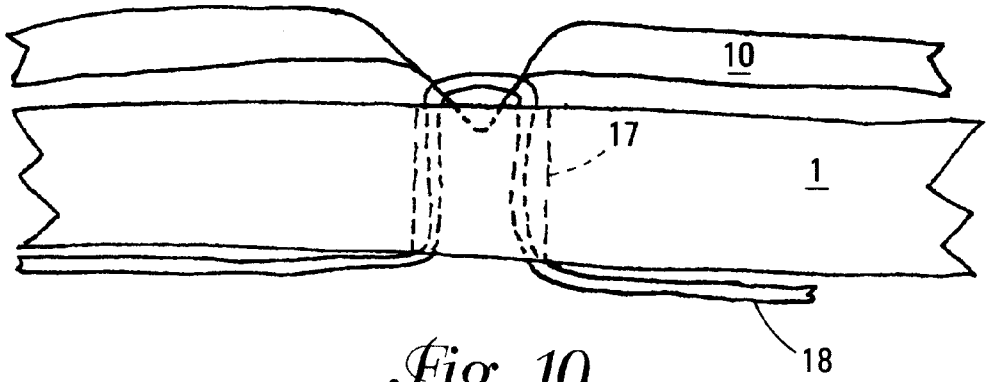
FIG. 10 is a cut-away view of an opening in the outer shell for attachment of the interior padding.
Figure 9A:
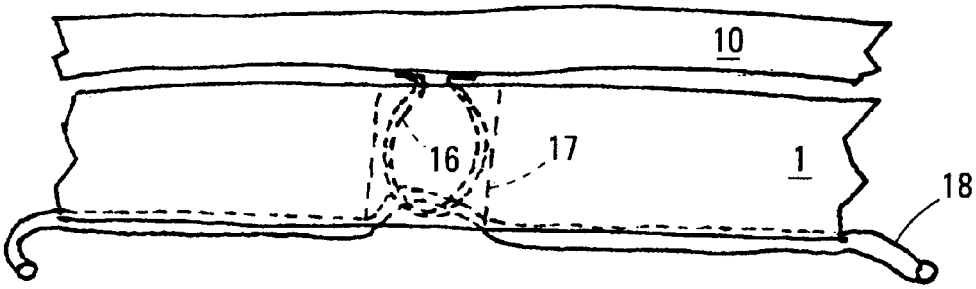
FIG. 9*a* is a cut-away view of an opening in the outer shell for attachment of the interior padding.

In another embodiment the interior padding 10 has small loops of fabric 16 sewn into the outer side of the interior padding 10 as shown in FIGS. 9 and 9*a*. These loops 16 would be positioned at the same point as openings 17 in the outer shell 1. The loops 16 could be inserted into the openings 17 with sufficient clearance such that an exterior padding strap 18 cord could be run on the exterior of the outer shell 1 through the loops 16 of the interior padding 10. Instead of loops 16 attached to the interior padding 10, holes 19 could be created in the interior padding 10 as illustrated in FIGS. 10 and 11. The exterior padding strap 18 could be inserted through these holes 19 through the openings 17 in the outer shell 1. Regardless of the way in which the interior padding 10 attaches to the exterior padding straps 18, the straps 18 could attach at the rear 20 of the headguard and also serve to adjust the size of the headguard and retain it on the head of the wearer.

A suspension-type headguard is also disclosed here. A suspension system may work best with an outer shell that also covers the top of the head, although a suspension system in a headguard that did not cover the top of the head is also within the scope of this invention.

Figure 12:
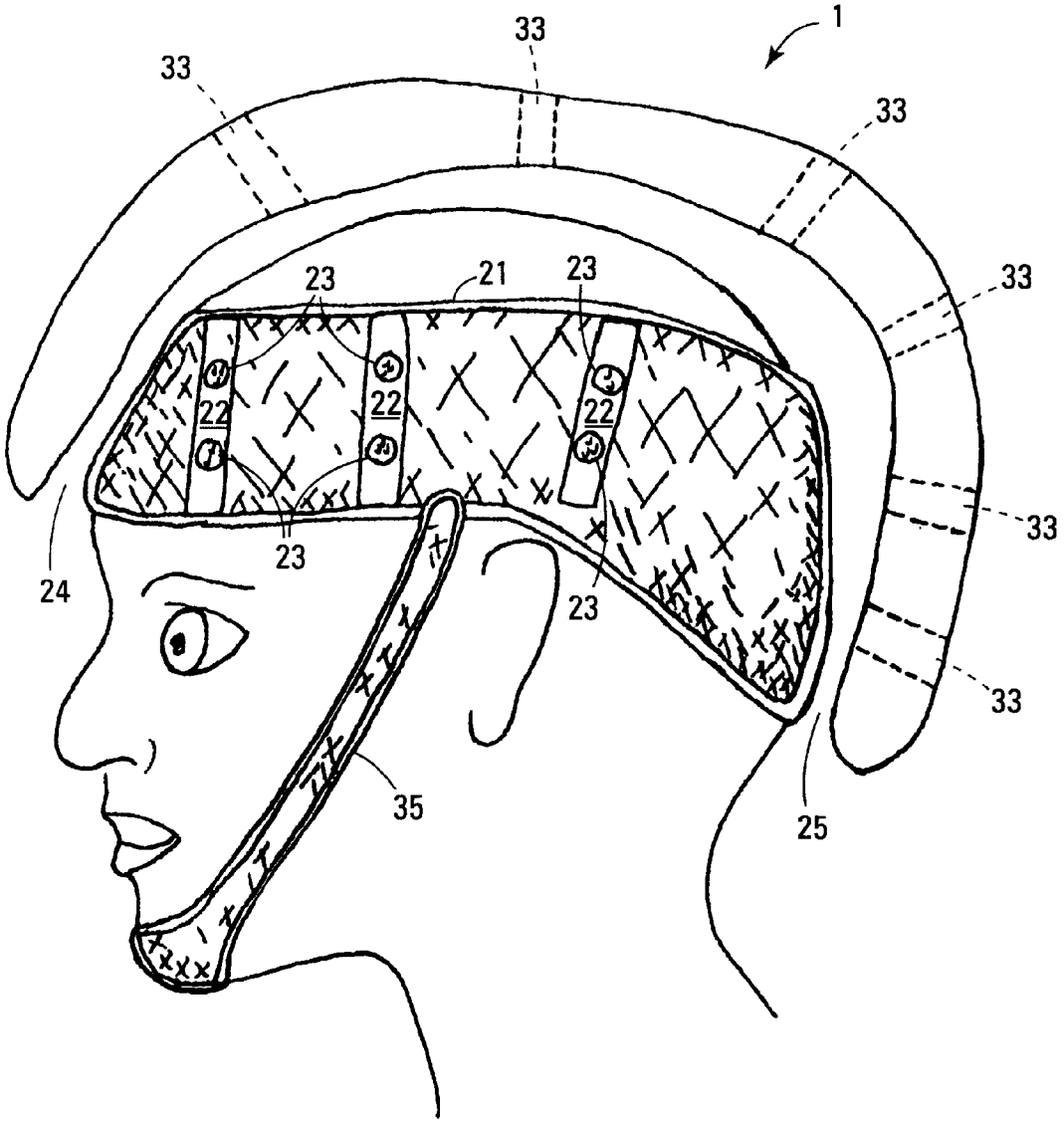
FIG. 12 is a side view of an exemplary headguard with a suspension system.
Figure 13:
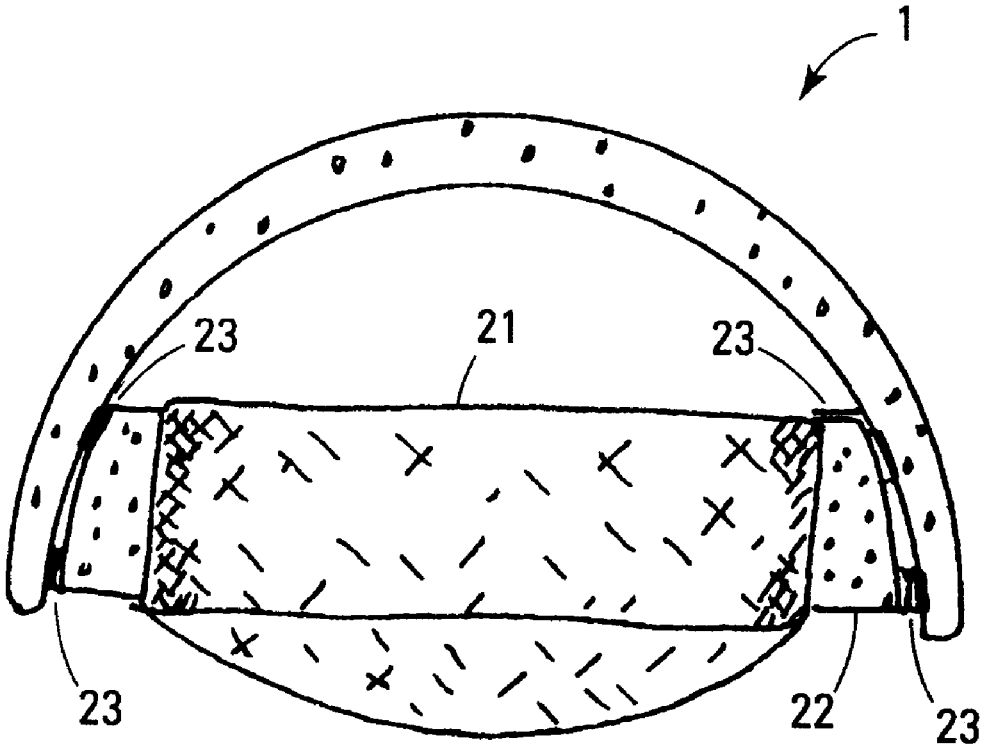
FIG. 13 is a front view of an exemplary headguard with a suspension system.
Figure 14:
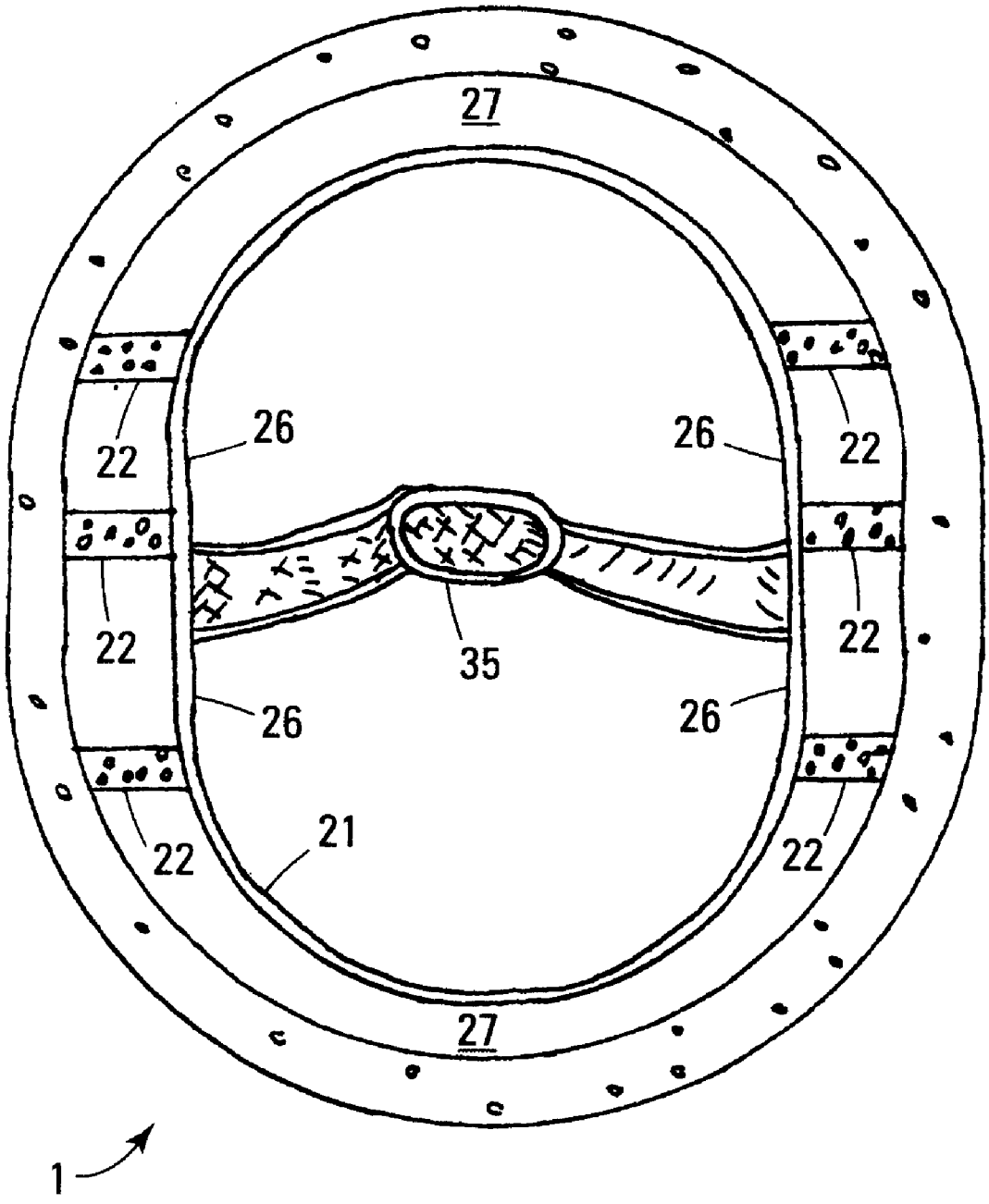
FIG. 14 is an overview of an exemplary headguard with a suspension system.

In one embodiment of the suspension headguard, a fabric headband 21 made of mesh or other stretchable fabric is worn by the wearer as illustrated in FIGS. 12–14. Spacers 22 are attached to the headband 21. The spacers 22 may be made of foam or other soft material. A single piece molded shell 1 removably mounts onto the spacers 22. The shell 1 may mount onto the spacers 22 with hook and loop fasteners 23.

The spacers 22 create air space 27 between the outer shell 1 and the head. The width of the spacers 22 could vary, depending on the amount of air space 27 desired between the outer shell 1 and the head. A distance of between 1/16 inch and 1 inch would be suitable for many applications.

The suspension headguard disclosed here differs from the typical suspension headguard in at least two respects. First, the suspension system disclosed here also has a means of retaining the headguard on the head. The stretchable fabric headband 21 stretches around the circumference of the head under the frontal bone 24 and under the occipital bone 25 thereby helping to retain the headguard on the head and in many uses obviating the need for a chinstrap 35. Second, the headguard disclosed here has at least four means by which the headguard can be adapted to fit uniquely shaped and sized heads: (a) the headband 21 can stretch around the head; (b) the spacers 22 may be compressed; (c) the spacers 22 may replaced with larger or smaller sized spacers 22; and (d) the shape of the molded or fabricated foam outer shell 1 can be altered in size and shape by the inward draw of the stretchable headband 21 or by the outward push of the spacers 22.

In one embodiment, the spacers 22 are positioned strictly along the side of the head as illustrated in FIGS. 12, 13 and 14. In such an embodiment the material of the headband 21 inbetween the spacers 22 along the sides of the headguard 26 may be made of non-stretchable material. Heads of varying size and shape could be accommodated both by stretching the front and back portions of the headband 21 and by space 27 between the headband 21 and the outer shell 1. Relatively wide or narrow heads are often difficult to fit with headgear but could be accommodated with the suspension headguard disclosed here as follows: When the headguard is placed on a relatively wide head, for example, the headband 21 stretches to fit the head; the spacers 22 push the sides of the headguard outward; the front and rear of the shell 1 are drawn inward; and the space 27 between the shell 1 and the front and back of the head accommodates inward movement of the front and rear of the shell 1.

If the headguard is placed on a relatively long, narrow head, the stretch of the headband 21 draws the spacers 22 on the side of the head inward; the sides of the outer shell 1 are correspondingly drawn inward; and the front and rear of the outer shell 1 are pushed outward to accommodate the front and rear of the longer head.

Figure 15:
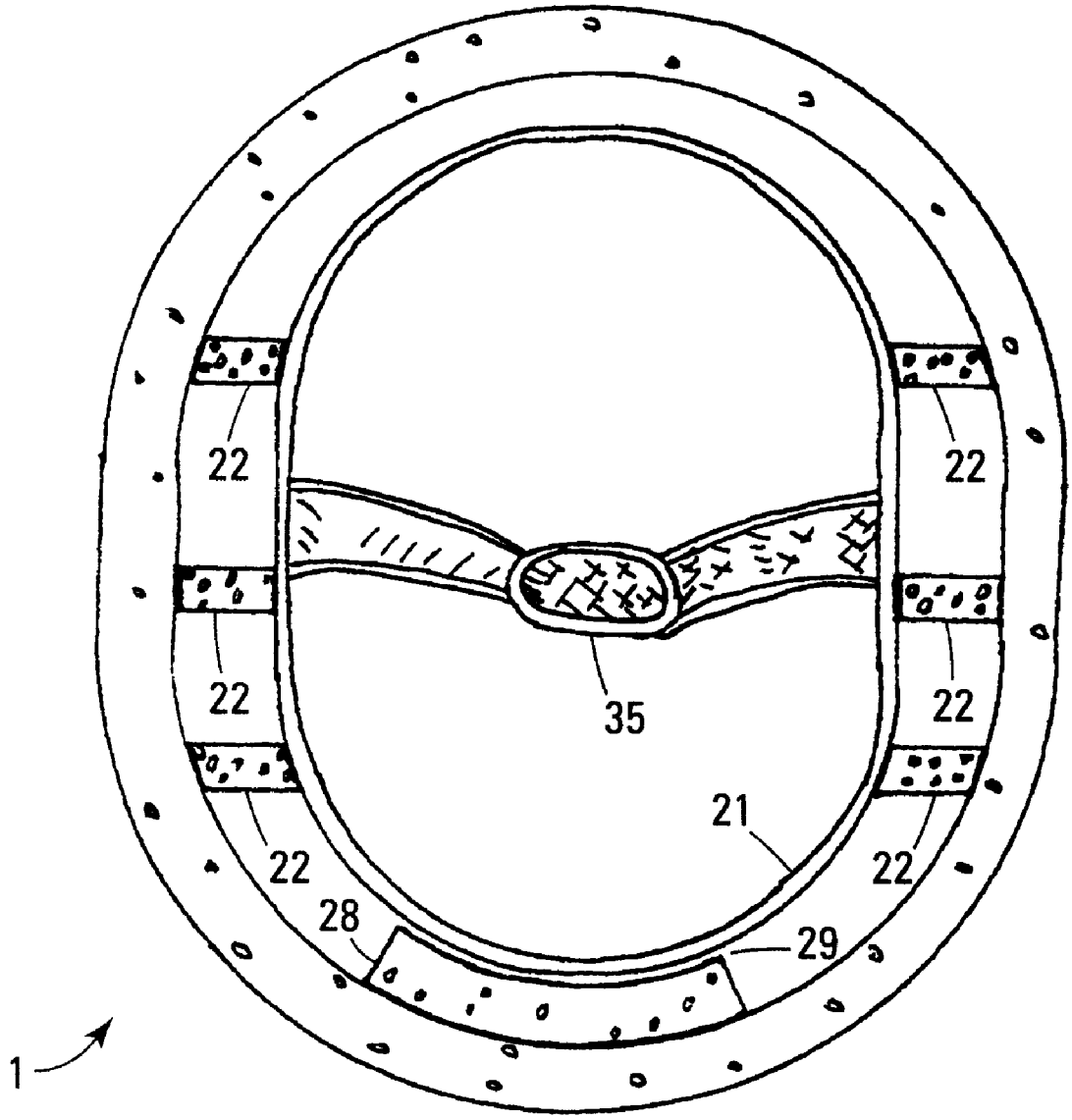
FIG. 15 is an overview of an exemplary headguard with a suspension system.

If the headguard is to be used by an on-field player who may head the ball, padding 28 could be attached to the interior side of the outer shell 1 in the area of the forehead as illustrated in FIG. 15. This padding 28 would not have to touch the forehead when placed on the head because a small gap 29 could be left between the padding 28 and the forehead. This space would still allow air to flow over the forehead. If an object struck the forehead such as a soccer ball, the gap 29 would be immediately eliminated and the wearer could head the ball.

Figure 16:
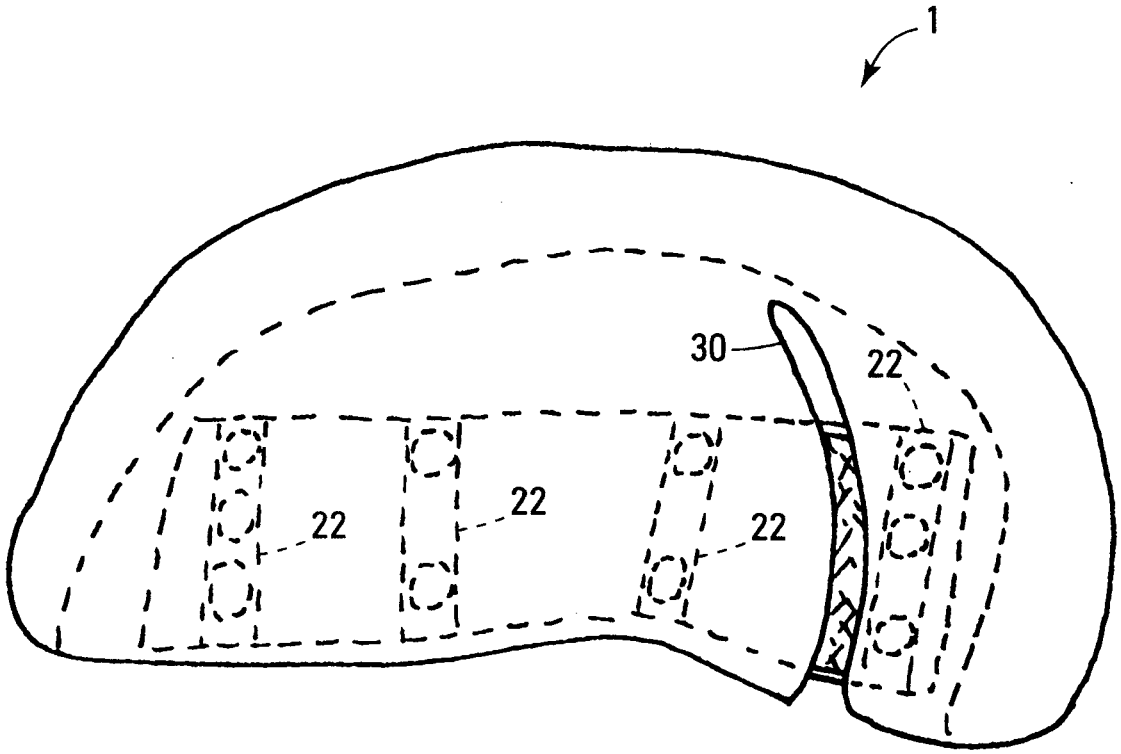
FIG. 16 is a side view of an exemplary headguard with a suspension system.
Figure 17:
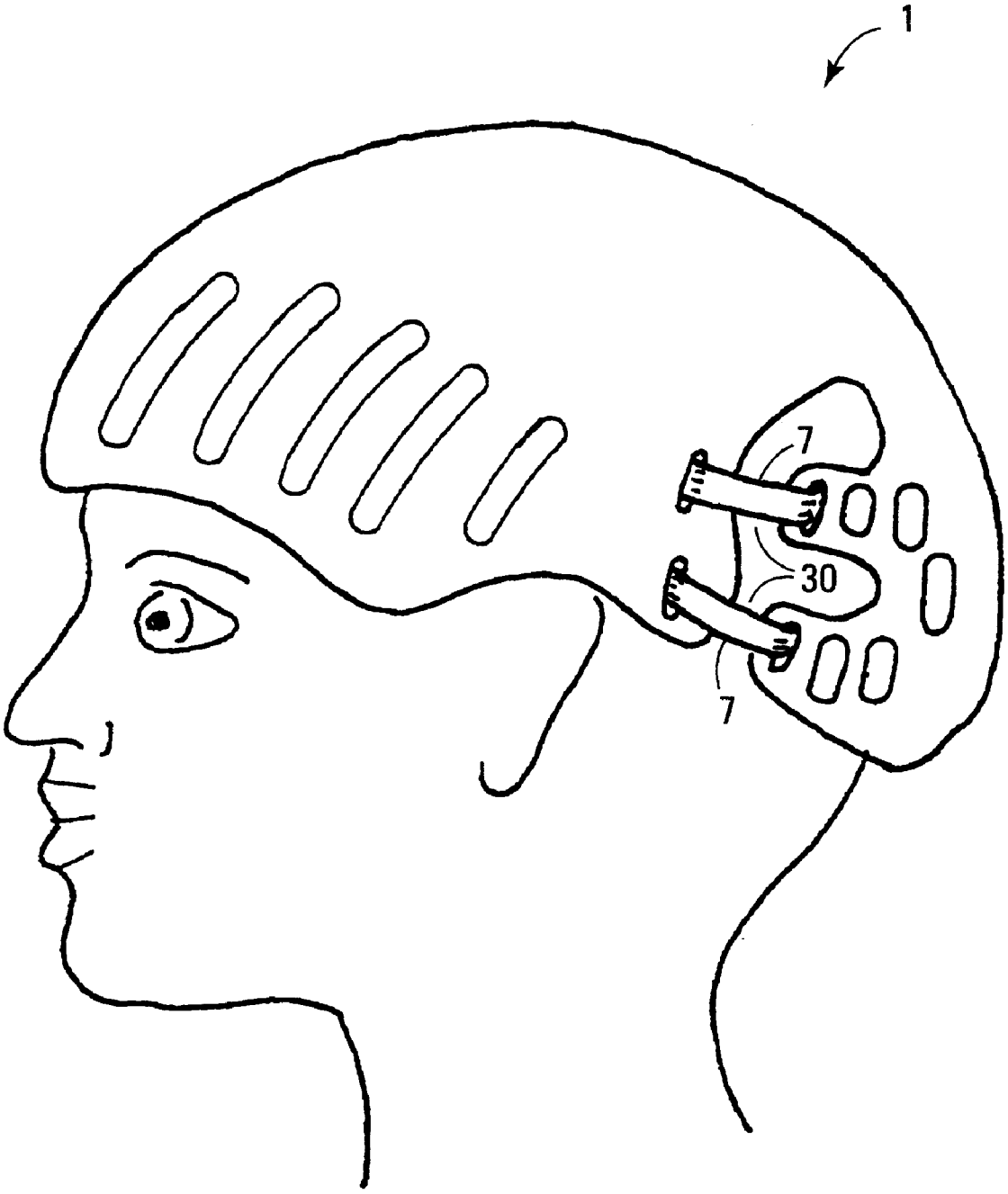
FIG. 17 is a side view of an exemplary headguard with contraction gap and without a suspension system.
Figure 17A:
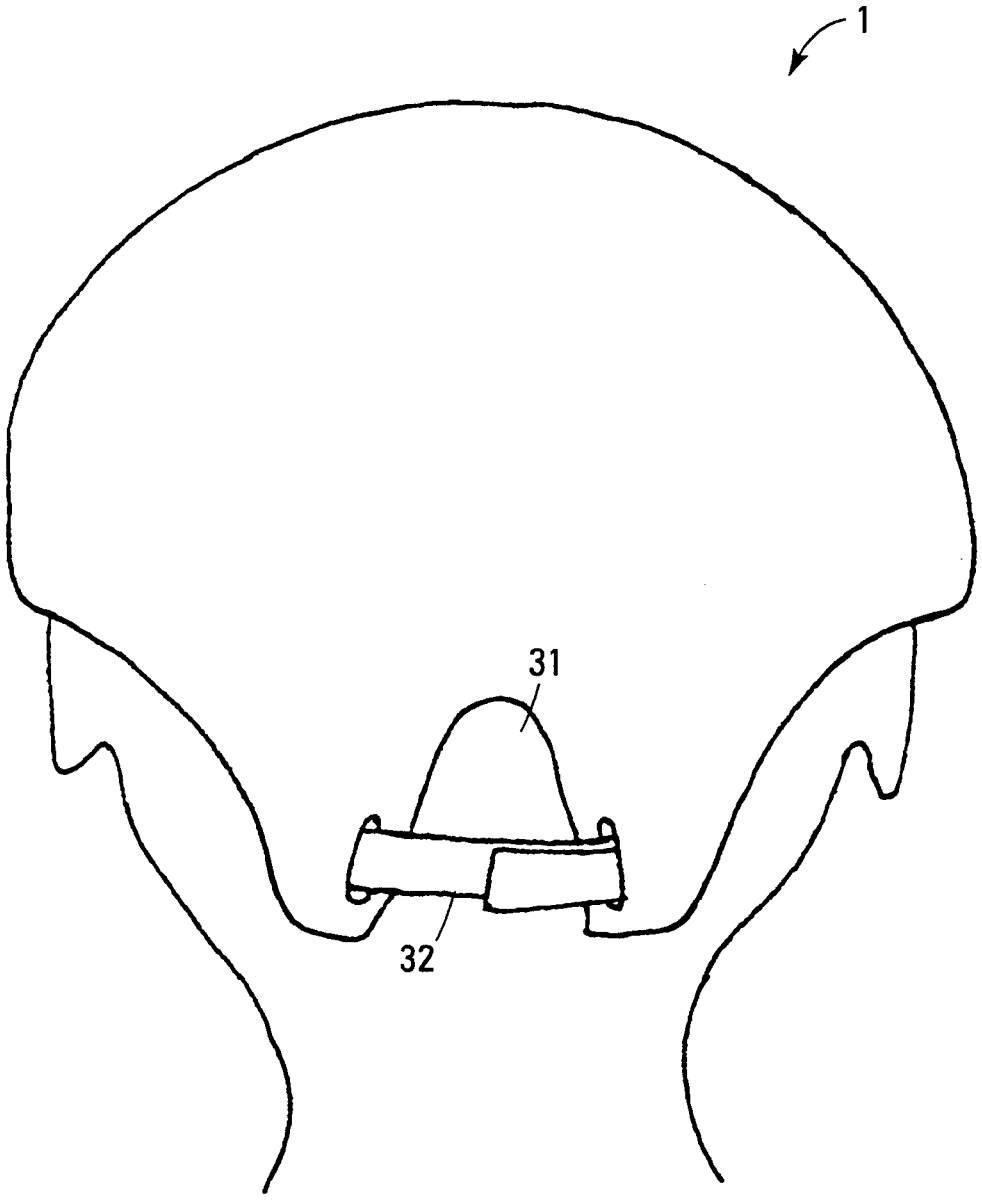
FIG. 17*a* is a rear view of an exemplary headguard with a contraction gap in the rear.

The shell 1 could have gaps or slits in it to accommodate contraction or expansion of the headguard as illustrated in FIGS. 16 and 17. The embodiment shown in FIG. 16 has an outer shell 1 with a contraction gap 30 mounted on the suspension system described above. Spacers 22 could be mounted to the headband 21 on either side of the contraction gap 30 to ensure that the outer shell 1 expands or contracts in unison with the expansion or contraction of the headband 21. The embodiment shown in FIG. 17 discloses a headguard with a contraction gap 30 but without a suspension system. In this embodiment, adjustment straps 7 could expand or contract the outer shell 1. In FIG. 17*a* a non-suspension headguard is also depicted with an expansion gap 31 in the rear of the headguard with an adjustment strap 32 spanning the gap 31 to adjust the fit and size of the headguard.

Figure 18:
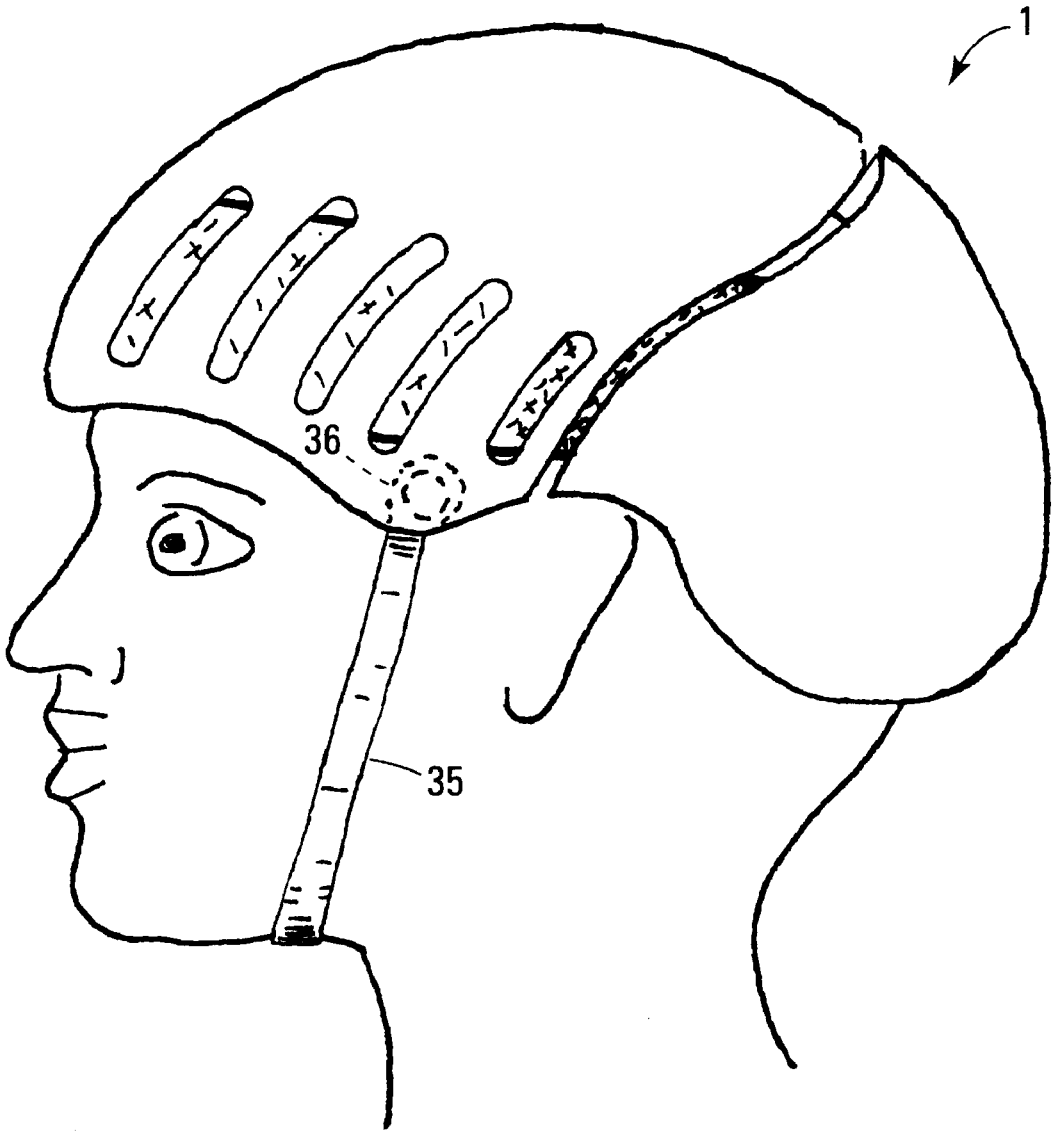
FIG. 18 is a side view of an exemplary headguard with a suspension system and a segmented outer shell.
Figure 19:
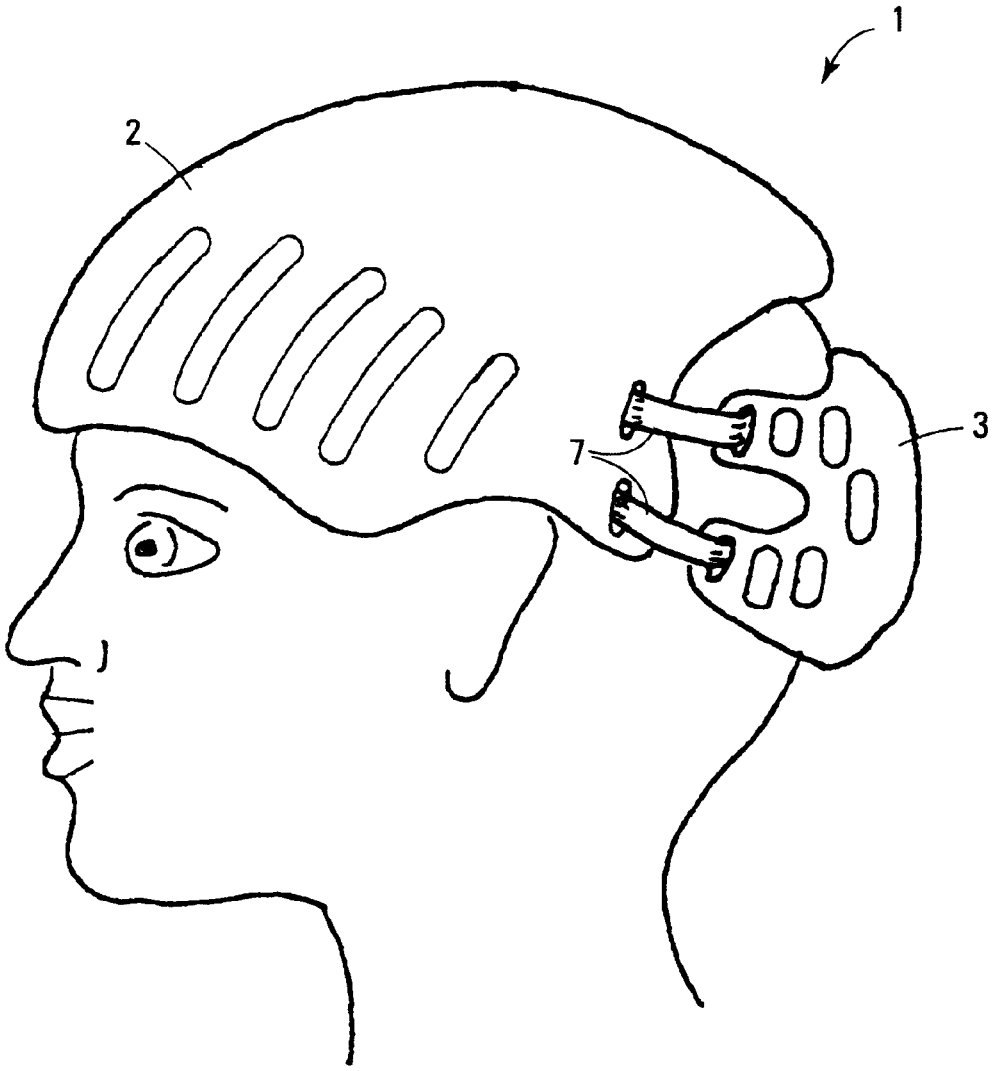
FIG. 19 is a side view of an exemplary headguard without a suspension system and with a segmented outer shell.
Figure 20:
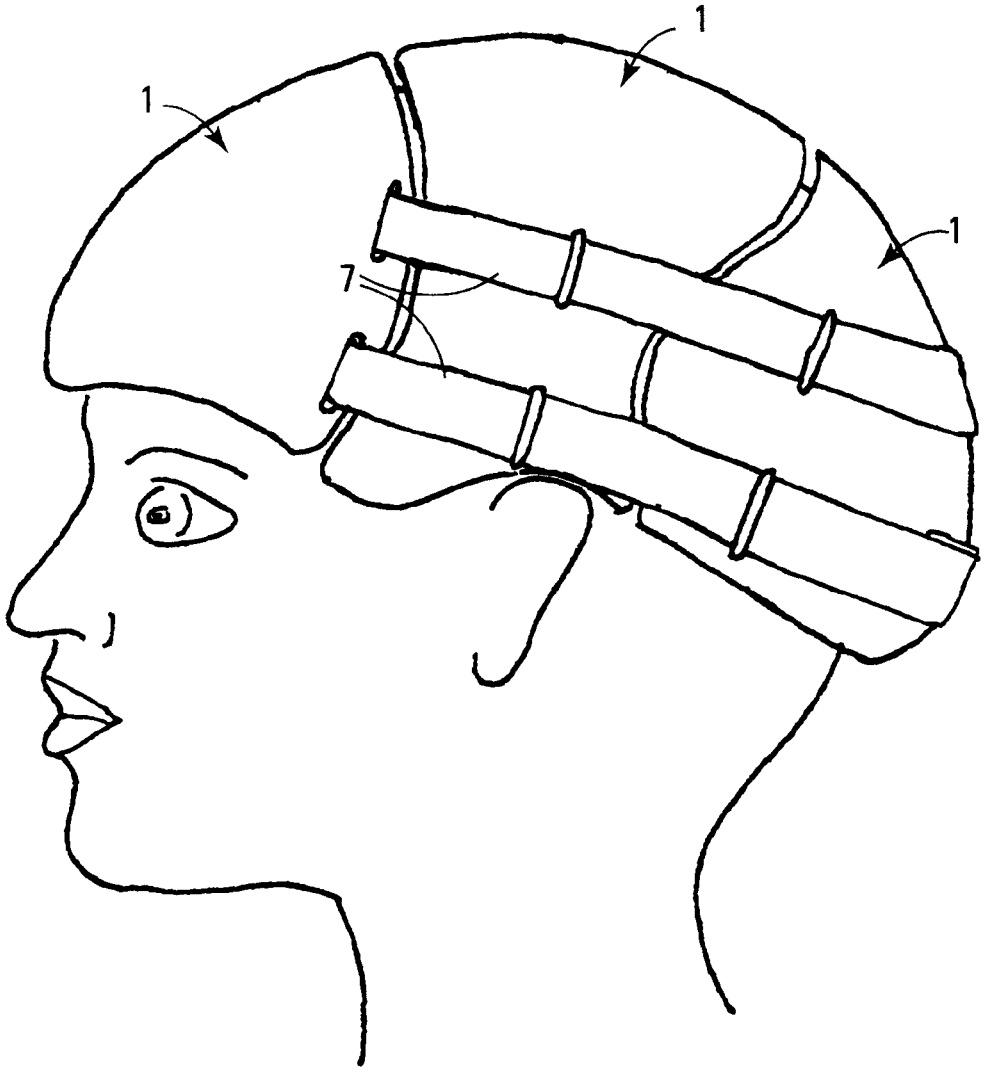
FIG. 20 is a side view of an exemplary headguard without a suspension system and with a segmented outer shell.

In another embodiment the outer shell 1 is divided into independent segments. Outer shells 1 with independent segments are illustrated in FIGS. 18–20. In FIG. 18 a suspension headguard with a segmented outer shell 1 is disclosed. In FIGS. 19 and 20, non-suspension headguards are disclosed that have segmented outer shells 1.

Figure 21:
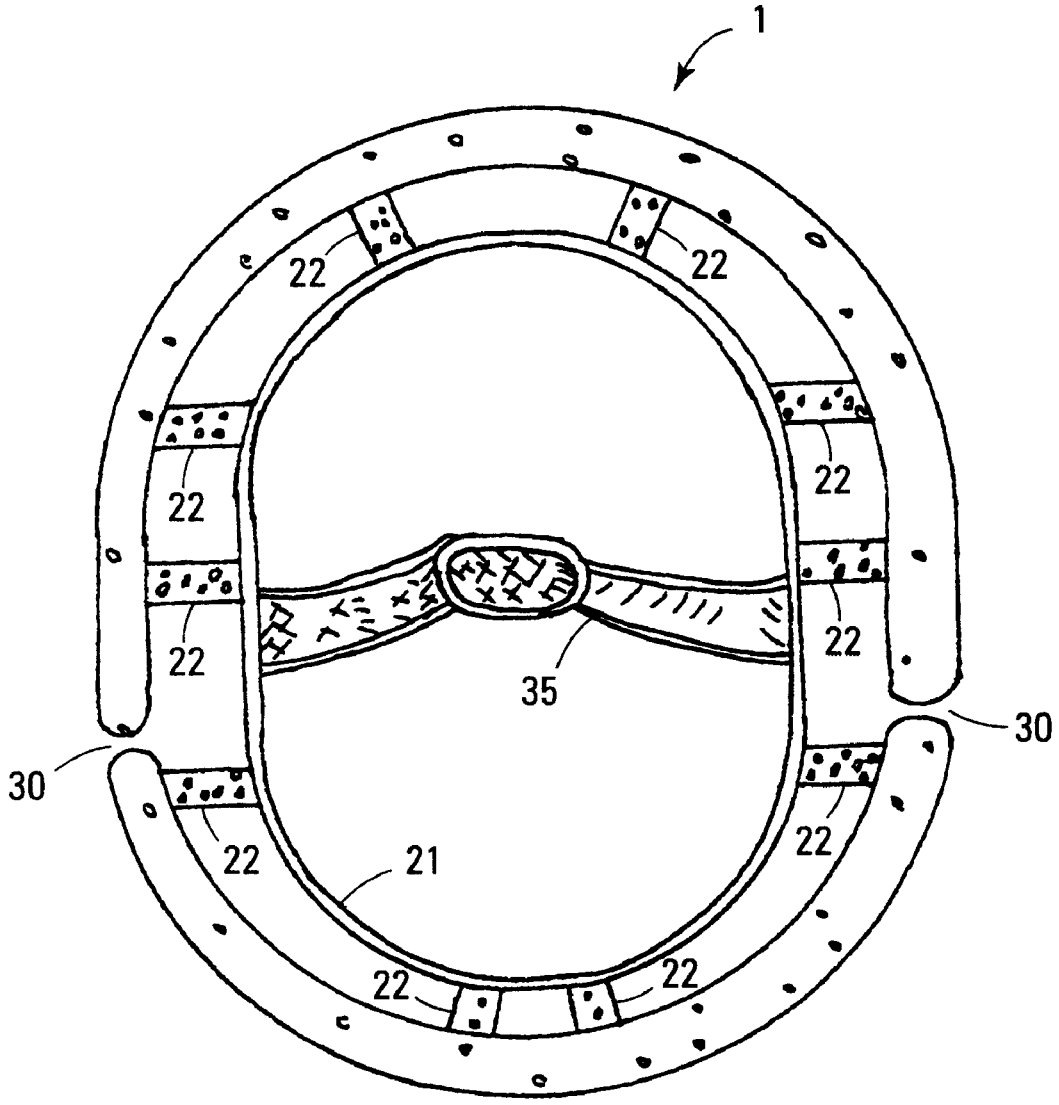
FIG. 21 is a side view of an exemplary headguard with a suspension system and with a segmented outer shell.

The suspension headguard disclosed in FIG. 18 may have spacers 22 mounted on the front and rear of the headband 21 as shown in FIG. 21. If spacers 22 are positioned in such a fashion, the distance between the outer shell 1 and the head of wearers with different head sizes would remain relatively constant. Head size and shape differences would be largely accommodated by expansion or contraction of the headband 21, the contraction gap 30 in the shell 1, and distortion of the outer shell 1.

In the embodiments of the headguard with spacers 22, the spacers 22 serve more than simply the purpose of sizing the headguard. The spacers 22 assist in ventilating the head of the wearer. Air can readily flow under the shell 1 and over the head and between the spacers 22. Ventilation holes 33 such as those depicted in FIG. 12 can further increase ventilation.

The spacers 22 also provide a means by which torsional forces can be better absorbed by the headguard. If non-direct forces are applied to the exterior of the headguard, the spacers 22 bend (as opposed to just compressing). This bending allows the entire headguard to distort in the direction of glancing forces thereby allowing a more gradual absorption of the torsional force.

Torsional force applied to the head is undesirable for several reasons. Such forces twist the neck, exposing it to injury. Such forces increase the likelihood of acceleration injuries, especially angular acceleration injuries, to the brain.

Figure 22:
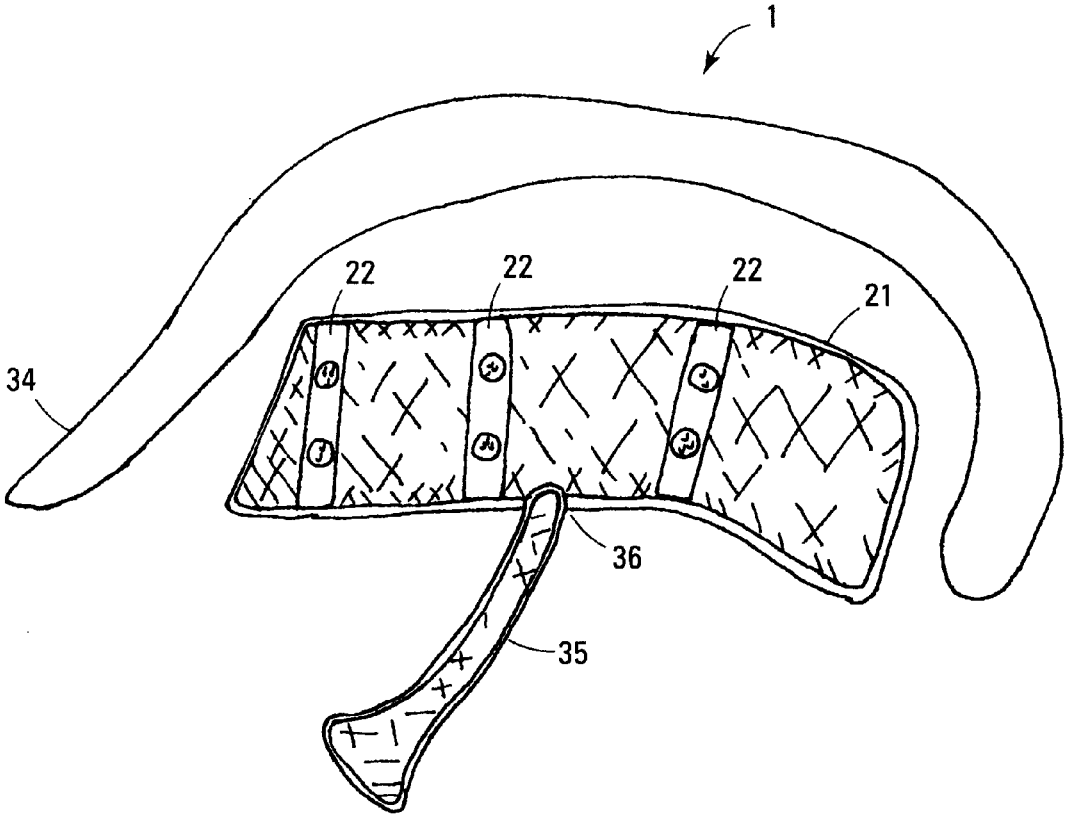
FIG. 22 is a side view of an exemplary headguard with a suspension system and an outer shell with a brim.

Other features which could be incorporated into the headguard include, for example, a brim 34 as illustrated in FIG. 22 which could be molded into the front the headguard to provide shading of the wearer's eyes. A chinstrap 35 could be incorporated into the headguard as illustrated, for example, in FIGS. 12, 14, and 18. Two alternatives are disclosed: one which cradles the chin, FIG. 12, and one which loops under the chin, FIG. 18, at a point forward of the vertical part of the neck. The chinstrap 35 could be made of a stretchable mesh. In addition, it could be attached to the headguard or the headband 21 with hook and loop fasteners 36 as illustrated in FIG. 18. Stretchable fabric would enable the chinstrap 35 to stretch in the event that torsional forces are applied twist the head in different directions. The hook and loop fasteners 36 would enable the chinstrap 35 to release if sufficient force is exerted on the headguard. Thus, if torsional forces are applied to the headguard, the chinstrap 35 would first stretch and then ultimately release as more force is applied.

Figure 23:
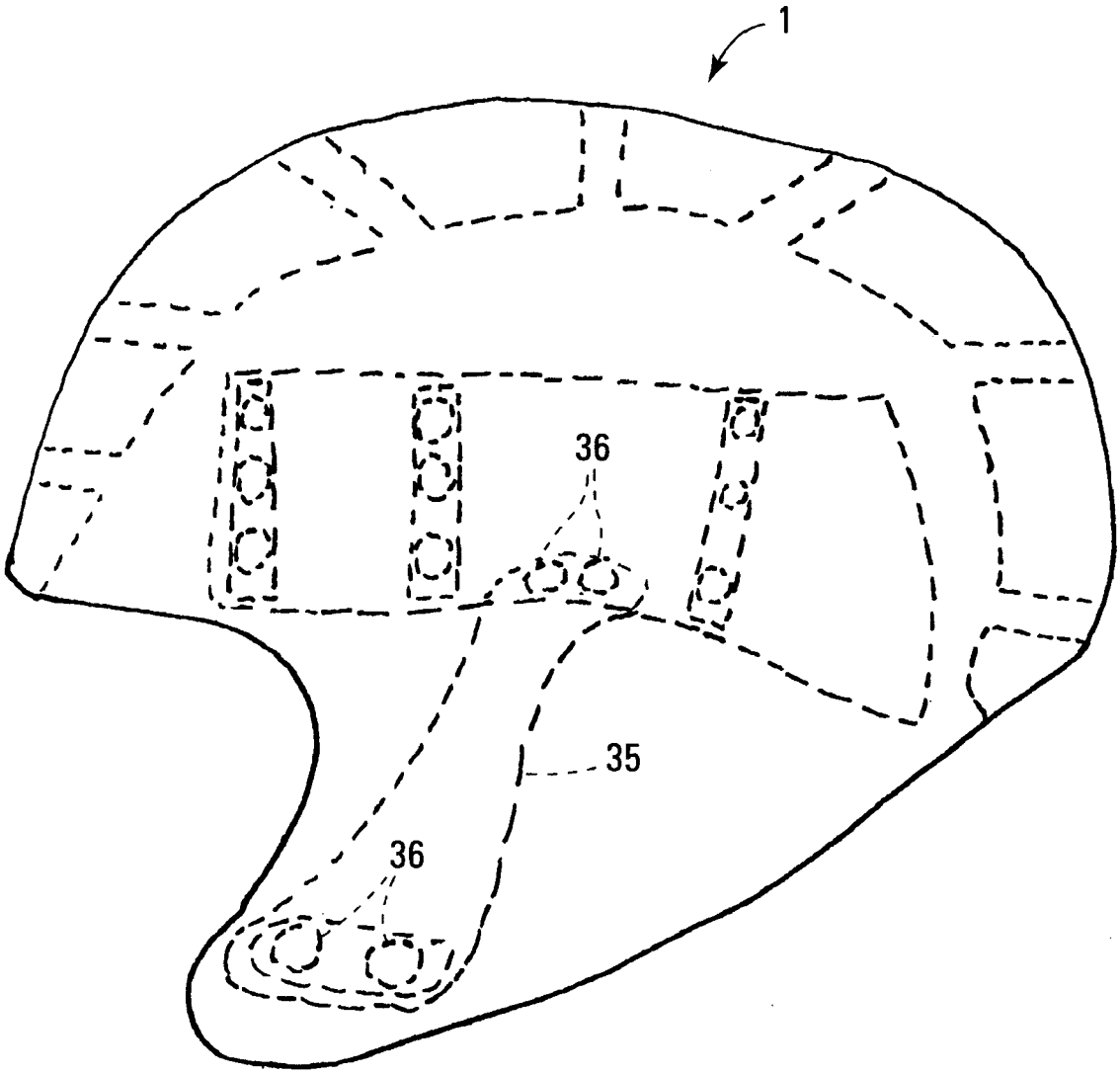
FIG. 23 is a side view of an exemplary headguard with a suspension system and side coverage of the head.

The protective surfaces of the headguard could be expanded to protect other areas of the head and face. This could make the headguard usable in other sports such as football, hockey, lacrosse or martial arts. For example, the sides of the headguard could be extended down both sides of the head in order to protect the jaw and the side of the face as illustrated in FIG. 23.

As noted above, the present invention provides a headguard which may be used in a number of different sports in which impacts to the head may occur. The present invention should not be considered limited to the particular examples described above, but rather should be understood to cover all aspects of the invention as fairly set out in the attached claims. For example, while suitable materials, fasteners, and the like have been disclosed in the above discussion, it should be appreciated that these are provided by way to of example and not of limitation as a number of other materials, fasteners, and so forth may be used without departing from the invention. Various modifications as well as numerous structures to which the present invention may be applicable will be readily apparent to those of skill in the art to which the present invention is directed upon review of the present specifications. The claims are intended to cover such modifications and structures.

What is claimed is:

1. A protective headguard to be worn by an athlete, comprising:

(a) a flexible exterior shell having an inner surface and an outer surface; and (b) a layer of stretchable fabric releasably connected to the inner surface of the shell at selected contact points with the fabric radially spaced from the shell between at least two of the contact points.

2. The headguard of claim 1 further comprising a spacer between the shell and the layer of fabric at one or more of the contact points effective for radially spacing the layer of fabric from the shell at the contact point.

3. The headguard of claim 2, wherein the spacers are made of compressible material.

4. The headguard of claim 1 wherein the shell and layer of fabric are configured and arranged so as not to cover a crown portion of an athlete's head when the headguard is worn.

5. The headguard of claim 1, wherein the shell is configured and arranged to cover a crown portion of an athlete's head when the headguard is worn.

6. The headguard of claim 1 wherein the fabric liner is configured and arranged to cover a crown portion of an athlete's head when the headguard is worn.

7. The headguard of claim 1 wherein the shell is made of a padding material.

8. The headguard of claim 1 wherein the layer of fabric defines a radial size within the shell and the radial size can be varied.

9. The headguard of claim 1 further comprising a brim radially extending from the shell which is configured and arranged so as to be longitudinally positioned above an athlete's eyes when the headguard is worn.

10. The headguard of claim 1 wherein the shell extends to cover at least a portion of the zygomatic and mandible bones of an athlete's head when the headguard is worn.

11. The headguard of claim 1 further comprising a removable pad positioned between the shell and the fabric liner in at least that area of the headguard covering at least a portion of an athlete's forehead when the headguard is worn.

12. A protective headguard to be worn by an athlete, comprising:

(a) a flexible exterior shell comprised of separate front and rear portions wherein: (i) the front portion has an inner surface and an outer surface, and is configured and arranged to cover at least a portion of an athlete's forehead and temple areas when the headguard is worn, and (ii) the rear portion has an inner surface and an outer surface and is configured and arranged to cover at least a portion of an athlete's occipital bone when the headguard is worn; and (b) a layer of stretchable fabric releasably connected to the inner surface of the shell at selected contact points with (i) at least two of the contact points with the front portion of the shell, (ii) at least one contact point with the rear portion of the shell, and (iii) the fabric radially spaced from at least the front portion of the shell between at least two of the contact points.

13. The head guard of claim 12 further comprising a spacer between the shell and the layer of fabric at one or more of the contact points effective for radially spacing the layer of fabric from the shell at the contact point.

14. The headguard of claim 13, wherein the spacers are made of compressible material.

15. The headguard of claim 12 wherein the shell and layer of fabric are configured and arranged so as not to cover a crown portion of an athlete's head when the headguard is worn.

16. The headguard of claim 12, wherein the shell is configured and arranged to cover at least a major portion of a crown portion of an athlete's head when the headguard is worn.

17. The headguard of claim 12 wherein the fabric liner is configured and arranged to cover at least a major portion of a crown portion of an athlete's head when the headguard is worn.

18. The headguard of claim 12 wherein the shell is made of a padding material.

19. The headguard of claim 12 wherein the layer of fabric defines a radial size within the shell and the radial size can be varied.

20. The headguard of claim 12 further comprising a brim radially extending from the shell which is configured and arranged so as to be longitudinally positioned above an athlete's eyes when the headguard is worn.

21. The headguard of claim 12 wherein the shell extends to cover at least a portion of the zygomatic and mandible bones of an athlete's head when the headguard is worn.

22. The headguard of claim 12 further comprising a removable pad positioned between the shell and the fabric liner in at least that area of the headguard covering at least a portion of an athlete's forehead when the headguard is worn.

23. A protective headguard to be worn by an athlete, comprising:

(a) a flexible shell defining a lateral direction and a longitudinal direction and comprised of separate front and rear portions separated by a longitudinally extending gap having a lateral width, wherein: (i) the front portion of the shell has an inner surface and an outer surface, and is configured and arranged to cover at least a portion of an athlete's forehead and temple areas when the headguard is worn, and (ii) the rear portion of the shell has an inner surface and an outer surface, and is configured and arranged to cover at least a portion of an athlete's occipital bone when the headguard is worn; and (b) an adjustable strap system interconnecting the front and rear portions of the shell and effective for adjusting the lateral width of the gap.

24. The headguard of claim 23 wherein (i) the shell further comprises a separate middle portion laterally positioned between the front and rear portions of the shell, (ii) the middle portion is separated from the front portion by a first lateral gap having a lateral width, (iii) the middle portion is separated from the rear portion by a second lateral gap having a lateral width, (iv) the adjustable strap system interconnects the front and middle portions of the shell and is effective for adjusting the lateral width of the first gap, and (v) the adjustable strap system interconnects the middle and rear portions of the shell and is effective for adjusting the lateral width of the second gap.

25. The headguard of claim 23 wherein the shell is made of a padding material.

26. The headguard of claim 24 wherein the middle portion of the shell is made of a padding material.

27. The headguard of claim 23 wherein the front portion of the shell includes a raised area of padding on the exterior surface configured and arranged to cover at least a central portion of a frontalis area of an athlete's head when the headguard is worn.

28. The headguard of claim 23 further comprising a liner releasably attached to the shell and covering at least a portion of the interior surface of the shell.

29. The headguard of claim 23 further comprising a longitudinally extending channel on the interior surface of the back portion of the shell configured and arranged to accommodate an occipital bone of an athlete when the headguard is worn.

* * * * *